US009636917B2

(12) United States Patent
Mizutani

(10) Patent No.: US 9,636,917 B2
(45) Date of Patent: May 2, 2017

(54) LIQUID SUPPLY UNIT

(71) Applicant: SEIKO EPSON CORPORATION, Tokyo (JP)

(72) Inventor: Tadahiro Mizutani, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/224,750

(22) Filed: Aug. 1, 2016

(65) Prior Publication Data

US 2017/0036449 A1 Feb. 9, 2017

(30) Foreign Application Priority Data

Aug. 6, 2015 (JP) ..... 2015-155742

(51) Int. Cl.
*B41J 2/175* (2006.01)

(52) U.S. Cl.
CPC ..... *B41J 2/1752* (2013.01); *B41J 2/17526* (2013.01)

(58) Field of Classification Search
CPC .. B41J 2/1752; B41J 2/17526; B41J 2/17523; B41J 2/17553; B41J 2/17502; B41J 2/17509
See application file for complete search history.

(56) References Cited

U.S. PATENT DOCUMENTS 5,619,237 A * 4/1997 Inoue ..... B41J 2/17503 347/86
8,485,642 B2 7/2013 Hayashi et al.

FOREIGN PATENT DOCUMENTS

JP 2008-074090 A 4/2008

* cited by examiner

*Primary Examiner* — Juanita D Jackson
(74) *Attorney, Agent, or Firm* — Global IP Counselors, LLP

(57) ABSTRACT

A liquid supply unit is provided with a first liquid housing chamber having a liquid supply part, a second liquid housing chamber, and a liquid communication part bringing the first liquid housing chamber and the second liquid housing chamber into communication, and a gap which receives a partition wall is formed between a first outer wall that defines the first liquid housing chamber and a second outer wall that defines the second liquid housing chamber.

16 Claims, 25 Drawing Sheets

LIQUID SUPPLY UNIT

BACKGROUND

1. Technical Field

The present invention relates to a technology for supplying a liquid to a liquid jet apparatus.

2. Related Art

Heretofore, as a technology for supplying ink to a printer, a technology is known that involves mounting an ink tank in an ink tank mounting part, and supplying ink that is in the ink tank to an ink receiving tube of a head unit that is provided in the ink tank mounting part (e.g., JP-A-2008-074090).

With the above technology, a black ink tank housing black ink and a color ink tank housing color ink of four colors are mounted in the ink tank mounting part. The ink tank mounting part has a partition wall disposed between a first mounting part in which the black ink tank is mounted and a second mounting part in which the color ink tank is mounted.

Here, there are calls to increase the ink capacity of the ink tanks (e.g., black ink tank) that are mounted in the ink tank mounting part. Also, it is desired to deliver improvements to existing technology, such as reduced costs, resource savings, simplified manufacturing and improved user friendliness. Such calls are not limited to ink tanks that house ink but are also commonly made with regard to liquid supply units that are mounted in liquid jet apparatuses, in order to supply liquids of types other than ink to the liquid jet apparatuses.

SUMMARY

Some aspects of the invention can be realized as the following modes and application examples.

(1) According to one mode of the invention, a liquid supply unit mountable in a liquid jet apparatus that includes a first mounting part having a liquid introduction part, a second mounting part, and a partition wall having a slit and separating the first mounting part and the second mounting part is provided. This liquid supply unit includes a bottom wall and an upper wall opposing the first wall. The liquid supply unit includes a first outer wall and a second outer intersecting the bottom wall and the upper wall. The liquid supply unit includes a first liquid housing chamber adapted to be mounted in the first mounting part in a mounted state in which the liquid supply unit is mounted in the liquid jet apparatus. The first liquid housing chamber is defined by the first outer wall. The liquid supply unit includes a second liquid housing chamber adapted to be mounted in the second mounting part in the mounted state. The second liquid housing chamber is defined by the second outer wall. The liquid supply unit includes a liquid supply part adapted to be connected to the liquid introduction part and supplying a liquid to the liquid introduction part in the mounted state. The liquid supply part is provided on the bottom wall and communicating with the first liquid housing chamber. The liquid supply unit includes a liquid communication part communicating with the first liquid housing chamber and the second liquid housing chamber. The liquid supply unit includes a gap configured to receive the partition wall in the mounted state. The gap is formed between the first outer wall and the second outer wall.

According to the above mode, due to the liquid supply unit having a gap, the liquid supply unit can be disposed to span the first mounting part and the second mounting part, without mounting being obstructed by the partition wall.

Thereby, in addition to liquid housed in the first liquid housing chamber that is mountable in the first mounting part being supplied from the liquid supply part to the liquid introduction part, liquid housed in the second liquid housing chamber that is mountable in the second mounting part can be circulated to the first liquid housing chamber via the liquid communication part. The volume of liquid that can be housed in the liquid supply unit can thereby be increased.

(2) The liquid supply unit may further comprise a first terminal adapted to be electrically connected to a first electrode part in the first mounting part of the liquid jet apparatus; a second terminal adapted to be electrically connected to a second electrode part in the second mounting part of the liquid jet apparatus; a first engagement part adapted to abut against a first engaging part, in the first mounting part of the liquid jet apparatus in the mounted state; and a second engagement part adapted to abut against a second engaging part in the second mounting part of the liquid jet apparatus in the mounted state.

According to the above mode, the first and second terminals can be securely connected to the first and second electrode parts by the first and the second engagement parts.

(3) In the liquid supply unit according to the above modes, when the liquid supply unit is seen in plan view looking in a downward direction in which the upper wall faces the bottom wall, in the mounted state, the liquid communication part may include a first liquid channel that overlaps with the partition wall.

According to the above mode, liquid in the second liquid housing chamber to be circulated to the first liquid housing chamber without being obstructed by the partition wall, using the liquid communication part including the first liquid channel.

(4) In the liquid supply unit according to the above modes, when the liquid supply unit is seen in plan view looking in the downward direction in the mounted state, the liquid communication part may include a second liquid channel that overlaps with the second mounting part.

According to the above mode, liquid in the second liquid housing chamber can be circulated to the first liquid housing chamber, using the liquid communication part including the second liquid channel.

(5) In the liquid supply unit according to the above modes, when the liquid supply unit is seen in plan view looking in the downward direction in the mounted state, the liquid communication part may include a third liquid channel that overlaps with the first mounting part.

According to the above mode, liquid in the second liquid housing chamber can be circulated to the first liquid housing chamber, using the liquid communication part including the third liquid channel.

(6) In the liquid supply unit according to the above modes, the first liquid channel may be provided in a position closer to the upper wall than to the bottom wall.

According to the above mode, liquid in the second liquid housing chamber can be circulated to the first liquid housing chamber without being obstructed by the partition wall, using the liquid communication part including the first liquid channel.

(7) In the liquid supply unit according to the above modes, the liquid supply unit may further include a bridging part connecting the first outer wall and the second outer wall. The bridging part may be configured to be inserted into the slit in the partition wall.

According to the above mode, the strength of the liquid supply unit having a gap can be improved by the bridging part.

(8) In the liquid supply unit according to the above modes, at least a portion of the liquid communication part may be provided in the bridging part.

According to the above mode, the first liquid housing chamber and the second liquid housing chamber can be brought into communication by effectively utilizing the bridging part.

(9) In the liquid supply unit according to the above modes, at least a portion of the liquid communication part may be provided in the bridging part at a position closer to the bottom wall than to the upper wall.

According to the above mode, Liquid housed in a portion of the second liquid housing chamber that is closer to the bottom wall than to the upper wall can be circulated to the first liquid housing chamber.

(10) In the liquid supply unit according to the above modes, at least a portion of the liquid communication part may be constituted by a tube.

According to the above mode, the degree of freedom in designing the liquid communication part can be improved.

(11) In the liquid supply unit according to the above modes, at least a portion of the liquid communication part may be formed in the upper wall.

According to this mode, at least a portion of the liquid communication part can be formed by utilizing the upper wall.

(12) In the liquid supply unit according to the above modes, the liquid supply unit may further include a first liquid holding member disposed to span the first liquid housing chamber, the second liquid housing chamber and the liquid communication part.

According to the above mode, liquid in the second liquid housing chamber can be smoothly moved to the first liquid housing chamber via the liquid communication part, using the first liquid holding member.

(13) In the liquid supply unit according to the above modes, the liquid supply unit may further include a second liquid holding member disposed, in the first liquid housing chamber, between the liquid supply part and the first liquid holding member.

According to the above mode, liquid can be held in the second liquid holding member.

(14) In the liquid supply unit according to the above modes, the liquid supply unit may further include an atmosphere communication channel communicating with an atmosphere outside the liquid supply unit and the first liquid housing chamber, and a liquid holding member disposed in the first liquid housing chamber.

According to this mode, liquid in the second liquid housing chamber can be smoothly introduced to the first liquid housing chamber via the liquid communication part following consumption of liquid in the first liquid housing chamber.

(15) In the liquid supply unit according to the above modes, the liquid supply unit may further include an atmosphere communication channel communicating with an atmosphere outside the liquid supply unit and the second liquid housing chamber, and a valve mechanism that switches the atmosphere communication channel and the second liquid housing chamber between a communication state and a non-communication state, according to a pressure in the second liquid housing chamber.

According to this mode, the communication state between the atmosphere communication channel and the second liquid housing chamber can be switched using the valve mechanism.

(16) In the liquid supply unit according to the above modes, the liquid supply unit may further include a liquid injection hole through which the liquid is injectable into the second liquid housing chamber, and a plug member for closing the liquid injection hole and attachable to and detachable from the liquid injection hole.

According to this mode, liquid can be easily injected into the second liquid housing chamber using the liquid injection hole.

For example, in one mode of the invention, the liquid supply unit is realizable as an apparatus provided with one or more of a plurality of elements including the first liquid housing chamber, the second liquid housing chamber and the liquid communication part. That is, this apparatus may or may not have the first liquid housing chamber. Also, this apparatus may or may not have the second liquid housing chamber. Also, this apparatus may or may not have the liquid communication part. Also, for example, in another mode of the invention, the liquid supply unit is realizable as an apparatus provided with one or more of a plurality of elements including the first liquid housing chamber, the second liquid housing chamber, the liquid communication part, the first terminal, the second terminal, the first engagement part and the second engagement part. That is, this apparatus may or may not have the first liquid housing chamber. Also, this apparatus may or may not have the second liquid housing chamber. Also, this apparatus may or may not have the liquid communication part. Also, this apparatus may or may not have the first terminal. Also, this apparatus may or may not have the second terminal. Also, this apparatus may or may not have the first engagement part. Also, this apparatus may or may not have the second engagement part. Also, for example, in another mode of the invention, the liquid supply unit is realizable as an apparatus provided with one or more of a plurality of elements including the first liquid housing chamber, the second liquid housing chamber, and the bridging part. That is, this apparatus may or may not have the first liquid housing chamber. Also, this apparatus may or may not have the second liquid housing chamber. Also, this apparatus may or may not have the bridging part. According to such various modes, at least one of issues such as reducing apparatus size, reducing costs, delivering resource savings, simplifying manufacturing and improving user-friendliness can be solved. Also, some or all of the technical features of the aforementioned modes of the liquid supply unit can be applied to this apparatus.

Note that the invention can be realized with various modes, and, apart from a liquid supply unit, can be realized with aspects such as a manufacturing method for a liquid supply unit and a liquid jet system provided with a liquid supply unit and a liquid jet apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

A-1. Overall Configuration of Liquid Jet System

Figure 1:
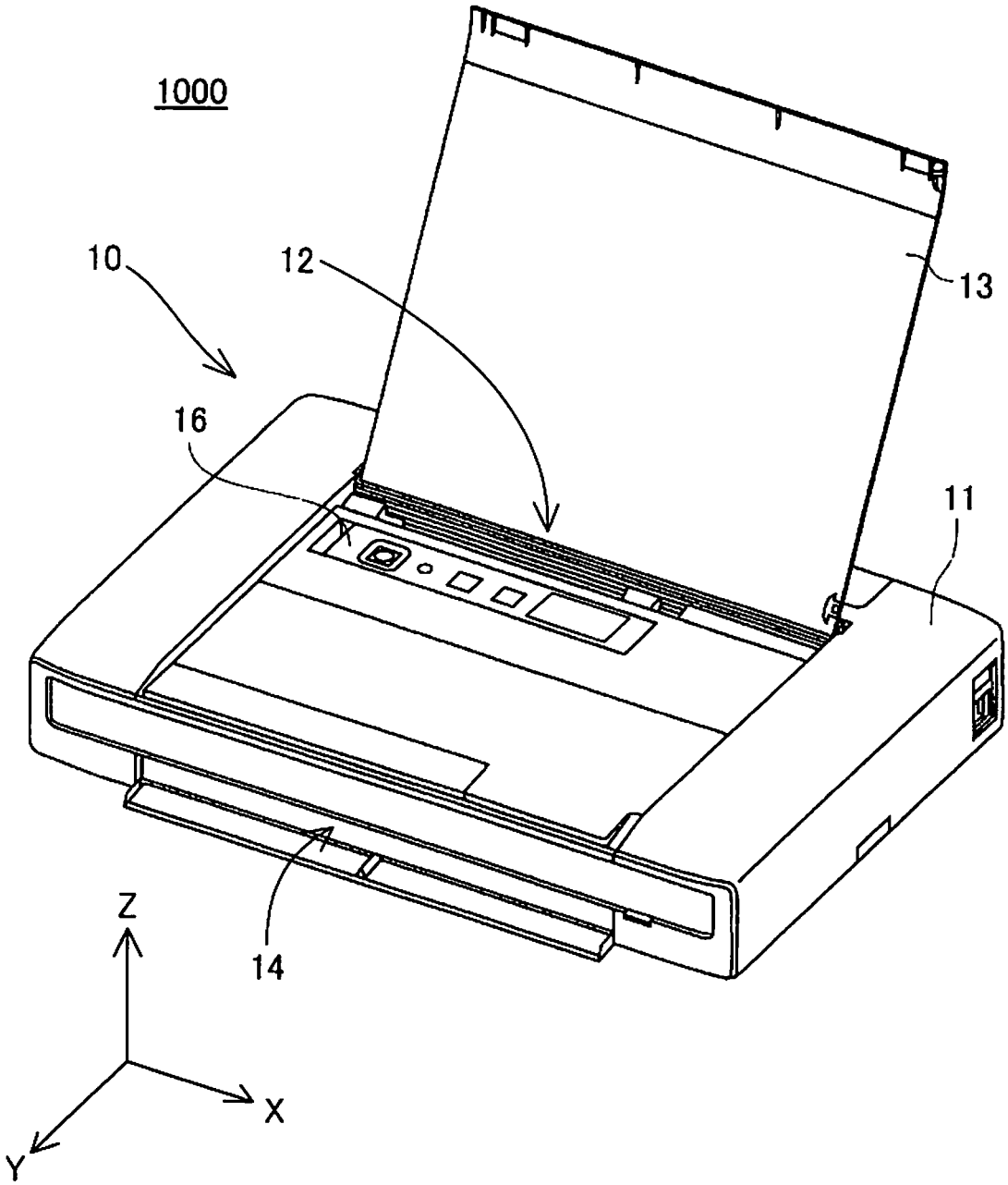
FIG. 1 is a schematic perspective view showing an external configuration of a liquid jet system serving as a first embodiment.

FIG. 1 is a schematic perspective view showing an external configuration of a liquid jet system 1000 serving as a first embodiment of the invention. The liquid jet system 1000 is provided with a printing apparatus 10 serving as a liquid jet apparatus, and a liquid supply unit (liquid supply container) which will be discussed later. In FIG. 1, arrows X, Y and Z indicating three directions intersecting each other orthogonally are illustrated. The arrow X indicates a right-left direction that is parallel to a lateral direction (width direction) of the printing apparatus 10, and indicates the direction from the left side to the right side when a user directly faces the printing apparatus 10. In this embodiment, the direction of the arrow X (+X direction) is parallel to a main scanning direction of a cartridge mounting part 27 in the printing apparatus 10 (discussed later). The arrow Y indicates a direction parallel to a back-front direction of the printing apparatus 10, and indicates the direction from the rearward side (back side) to the forward side (front side) when a user directly faces the printing apparatus 10. In this embodiment, the direction of the arrow Y (+Y direction) coincides with a sub-scanning direction (discussed later). The arrow Z indicates a height direction of the printing apparatus 10. The direction of the arrow Z (+Z direction) indicates vertically upward. Note that in each of the other diagrams that are used in the description of this specification, the arrows X, Y and Z are also illustrated so as to correspond to FIG. 1, as appropriate. Also, in this specification, when "left" and "right" are referred to, this signifies directions referenced on the direction of the arrow X. Similarly, when "front" and "back" are referred to, this signifies directions referenced on the direction of the arrow Y of the printing apparatus 10, and when "up" and "down" are referred to, this signifies directions referenced on the direction of the arrow Z of the printing apparatus 10. Also, the direction in +X direction is given as the X direction, the direction in the +Y direction is given as the Y direction, and the direction in the +Z direction is given as the Z direction.

The printing apparatus 10 is an inkjet printer, which is one aspect of the liquid jet apparatus. The printing apparatus 10 forms an image by ejecting ink droplets onto a printing sheet according to print data that is supplied from outside. The printing apparatus 10 circulates ink housed in the liquid supply unit to the printing apparatus 10 side using a suction mechanism such as a pump. The printing apparatus 10 is provided with a casing 11, a sheet feeding port 12, an upper cover 13, a sheet discharge port 14 and an operation unit 16. The casing 11 is an exterior member housing a print mechanism (discussed later) of the printing apparatus 10. The sheet feeding port 12 is an opening provided in a rearward portion of the casing 11 so as to be open upward. Printing sheets, which are printing media, are supplied to a main body inside the casing 11 via the sheet feeding port 12.

The upper cover 13 is the tabular member turnably attached to the casing 11 in the vicinity of the sheet feeding port 12. The upper cover 13, when in an open state (illustrated state), functions as a guide plate for when sending printing sheets to the sheet feeding port 12, and, when in a closed state, functions as a lid that covers and protects the upper middle portion of the casing 11. The paper discharge port 14 is an opening provided in the front of the casing 11. Printing sheets sent inside the casing 11 via the sheet feeding port 12 are discharged to the outside via the paper discharge port 14. The operation unit 16 is provided with buttons that accept operations by the user, and a display that displays information to the user. The operation unit 16 is provided on the upper surface of the casing 11, and the user is able to access the operation unit 16 when the upper cover 13 is in an open state.

Figure 2:
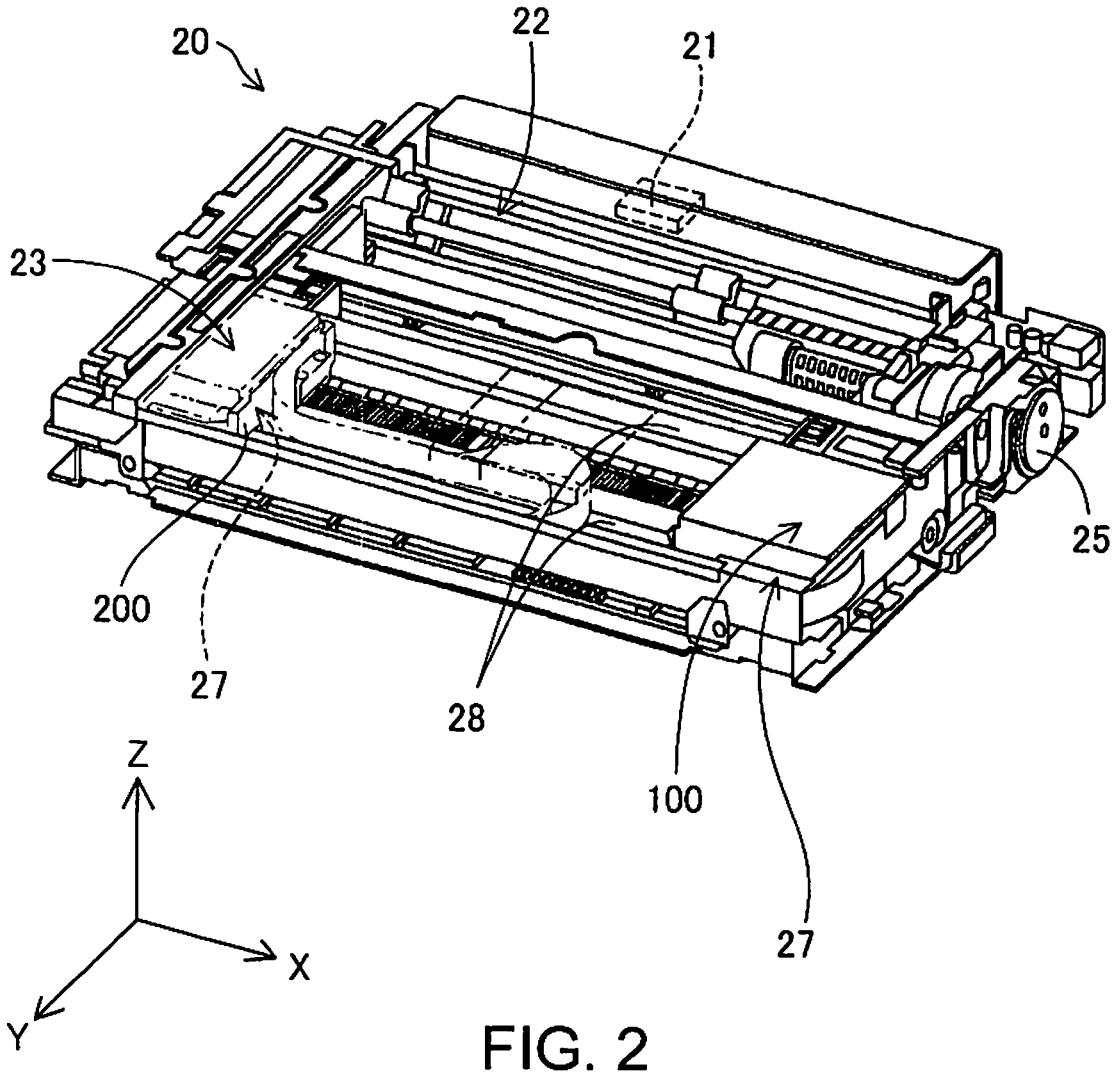
FIG. 2 is a schematic perspective view showing an external configuration of a print mechanism.

FIG. 2 is a schematic perspective view showing an external configuration of a print mechanism 20 removed from inside the casing 11 of the printing apparatus 10. The movement locus of the cartridge mounting part 27 is schematically illustrated by a broken line in FIG. 2. The print mechanism 20 is provided with a controller 21, a conveyance part 22, and a printing part 23. The controller 21 is constituted by a microcomputer that is provided with a central processing unit and a main storage. The controller 21 executes print processing by controlling the constituent parts of the printing apparatus 10 according to operations performed by the user via the operation unit 16 or instructions from an external computer.

The conveyance part 22 conveys printing sheets introduced from the sheet feeding port 12 (FIG. 1) to the paper discharge port 14 (FIG. 1) via a conveyance path (illustration omitted) extending in the direction of the arrow Y inside the print mechanism 20, by the turning drive of a conveyance roller 25.

The printing part 23 is disposed on the conveyance path of the printing sheets, and executes printing on the printing sheets conveyed by the conveyance part 22. The printing part 23 is provided with the cartridge mounting part 27 and a guide rail 28. The printing apparatus 10 of this embodiment is a so-called on-carriage type of printing apparatus, and one liquid supply unit (liquid supply container) 100 is detachably mounted in the cartridge mounting part 27.

The cartridge mounting part 27 has a print head (illustration omitted) that ejects ink droplets on the side opposing the printing sheets. The print head has an ink channel, a nozzle that ejects ink, and a mechanism that generates a driving force for ink ejection (e.g., a piezoelectric element in the case of a piezoelectric method, a heater in the case of a thermal method, etc.). The operations of the cartridge mounting part 27 are controlled by the controller 21. Specifically, the cartridge mounting part 27 ejects ink droplets toward the surface of a printing sheet conveyed in the sub-scanning direction by the conveyance part 22, while moving back and forth along the guide rail 28, which lays in the direction of the arrow X. The main scanning direction in which the cartridge mounting part 27 moves back and forth is parallel to the direction of the arrow X. Note that the printing apparatus 10 may be a line printer in which the cartridge mounting part 27 does not move.

Figure 3:
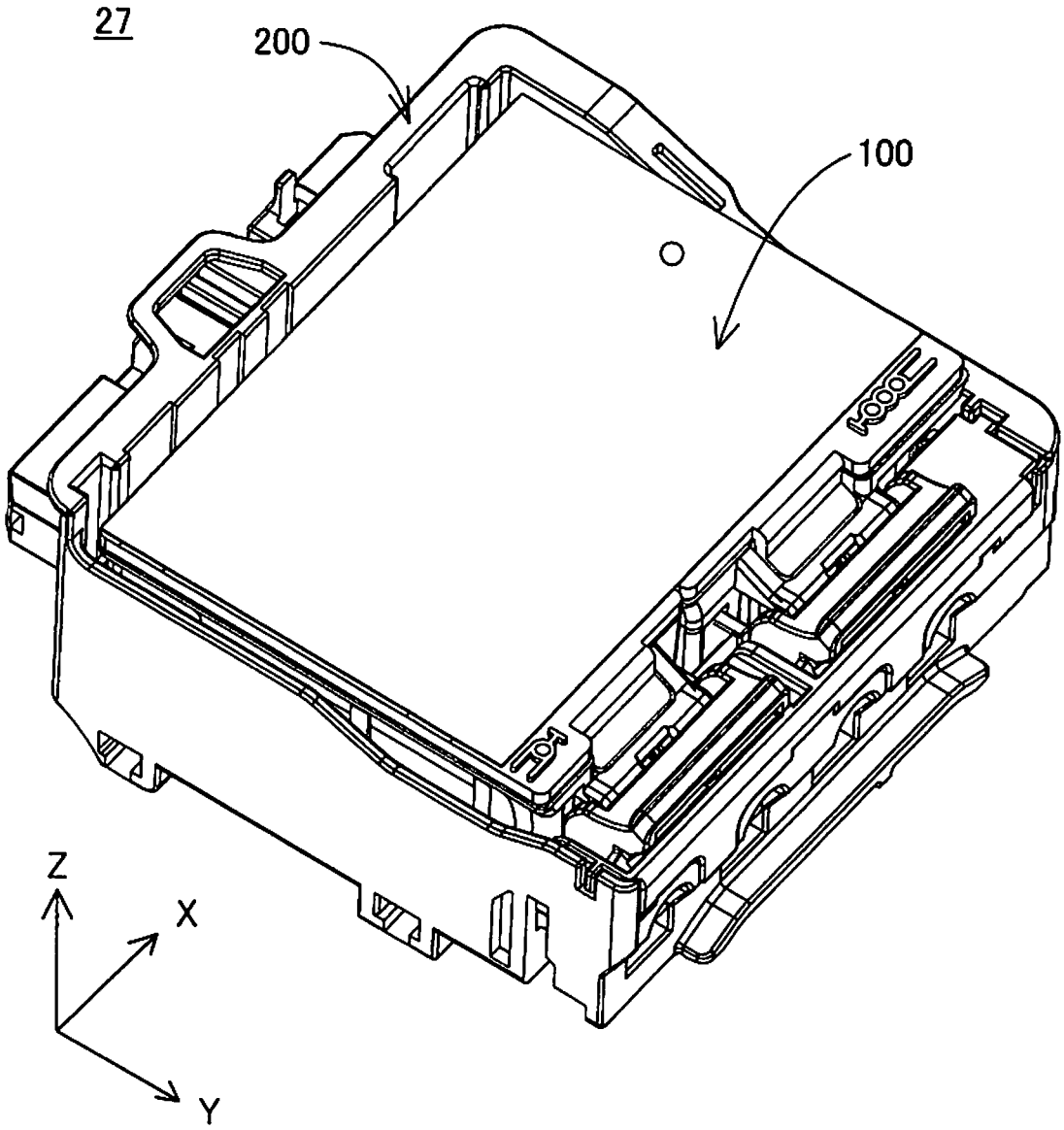
FIG. 3 is a schematic perspective view showing a cartridge mounting part in a mounted state in which a liquid supply unit is mounted.

FIG. 3 is a schematic perspective view showing the cartridge mounting part 27 in a mounted state in which the liquid supply unit 100 is mounted. A carriage unit 200 of the cartridge mounting part 27 is a box body having a substantially rectangular parallelepiped shape that is open upward. Inside of the carriage unit 200, the liquid supply unit 100 is housed in a state in which the entire upper surface thereof is exposed. The print head is provided on the lower surface of the carriage unit 200.

The outside of the liquid supply unit 100 has a substantially rectangular parallelepiped shape. The liquid supply unit 100 houses one type of ink therein. In this embodiment, the liquid supply unit 100 houses black ink. Note that, in the other embodiments, the liquid supply unit 100 may house one type of color ink of a color such as cyan, yellow and magenta.

A-2. Detailed Configuration of Cartridge Mounting Part

Figure 4:
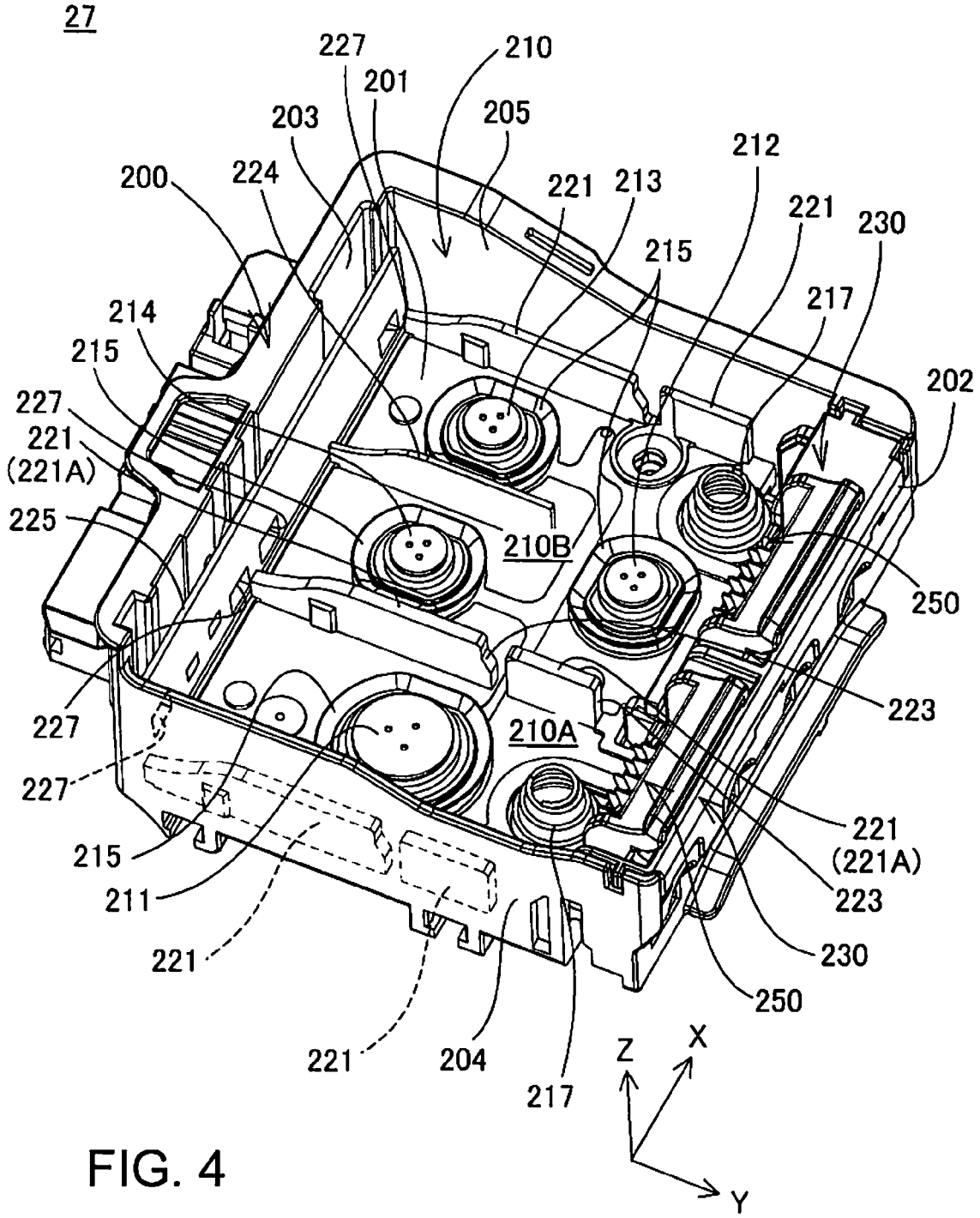
FIG. 4 is a first external perspective view of a cartridge mounting part.
Figure 5:
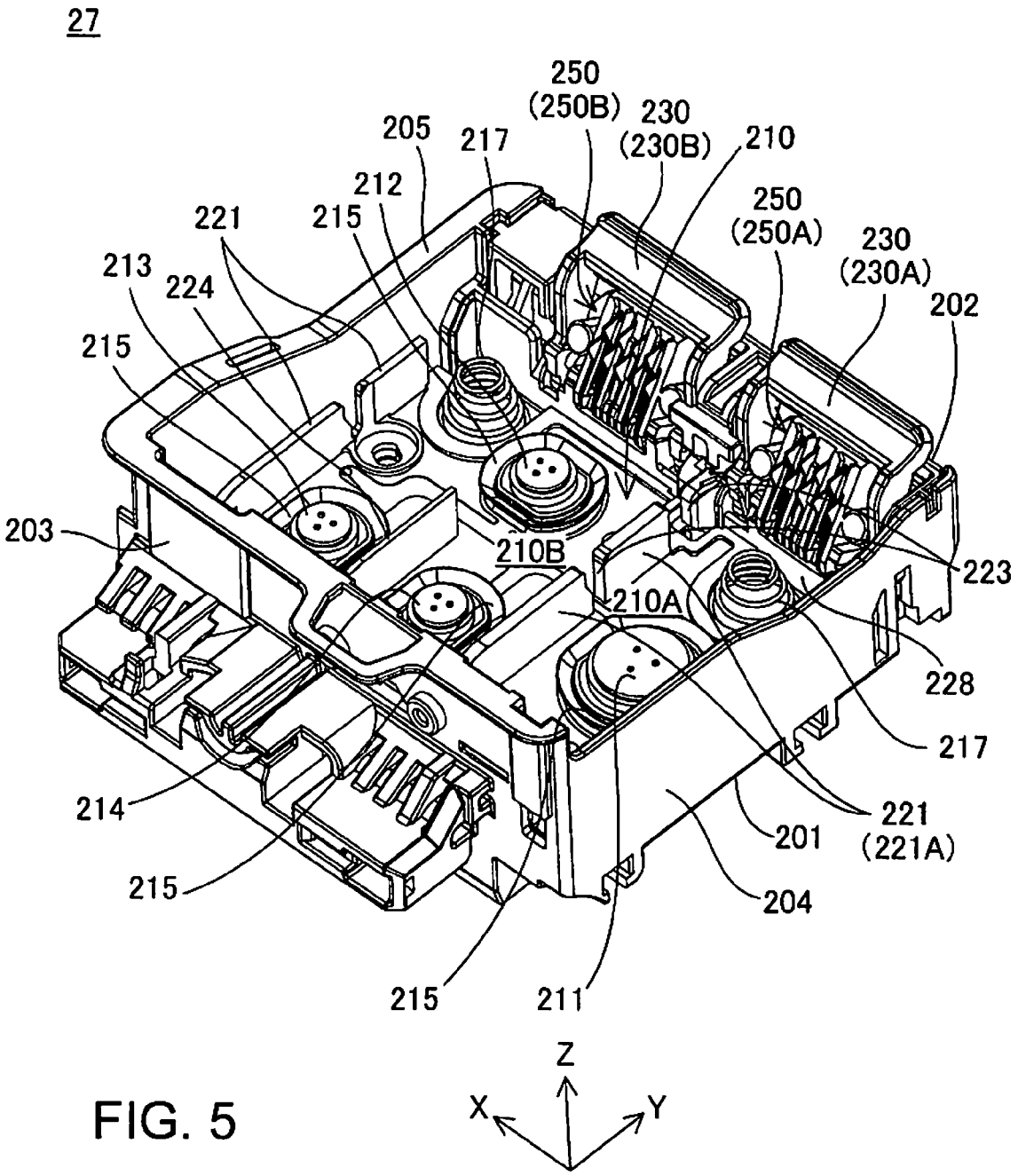
FIG. 5 is a second external perspective view of the cartridge mounting part.
Figure 6:
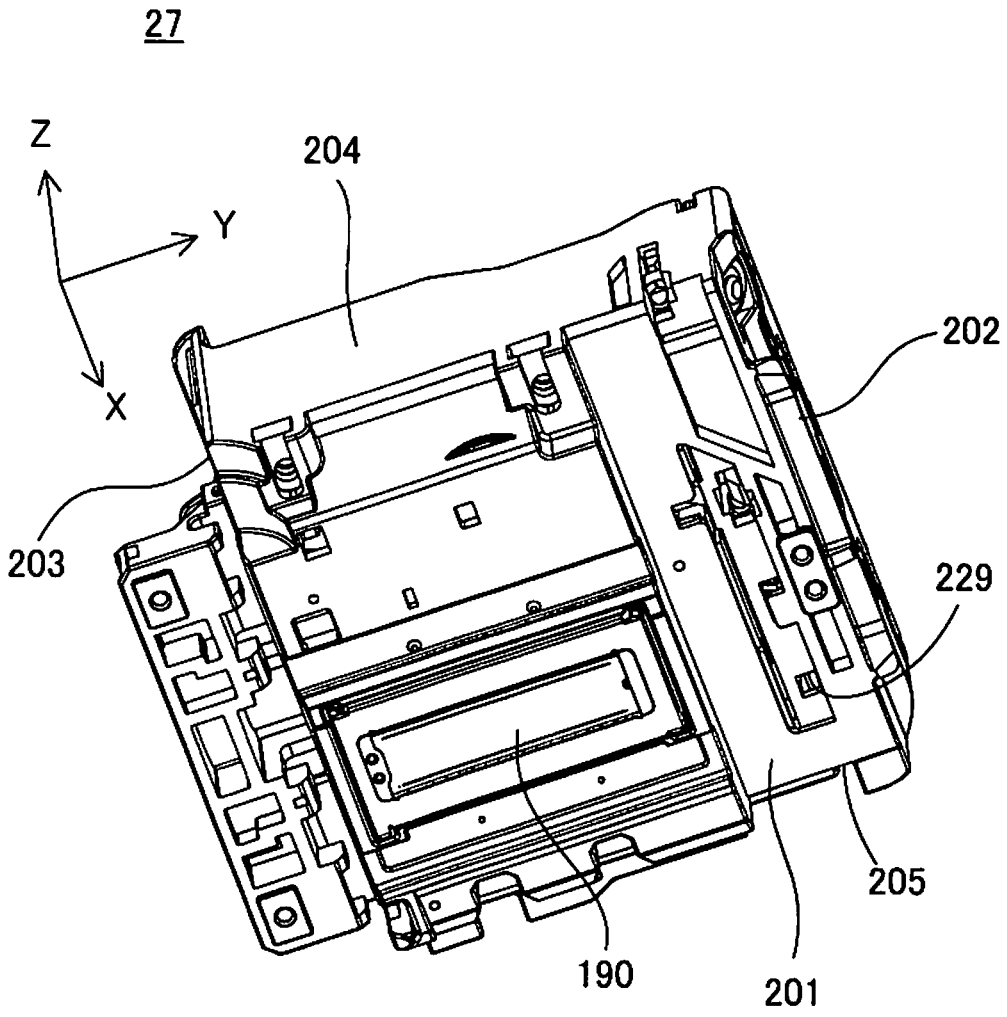
FIG. 6 is a third external perspective view of the cartridge mounting part.
Figure 7:
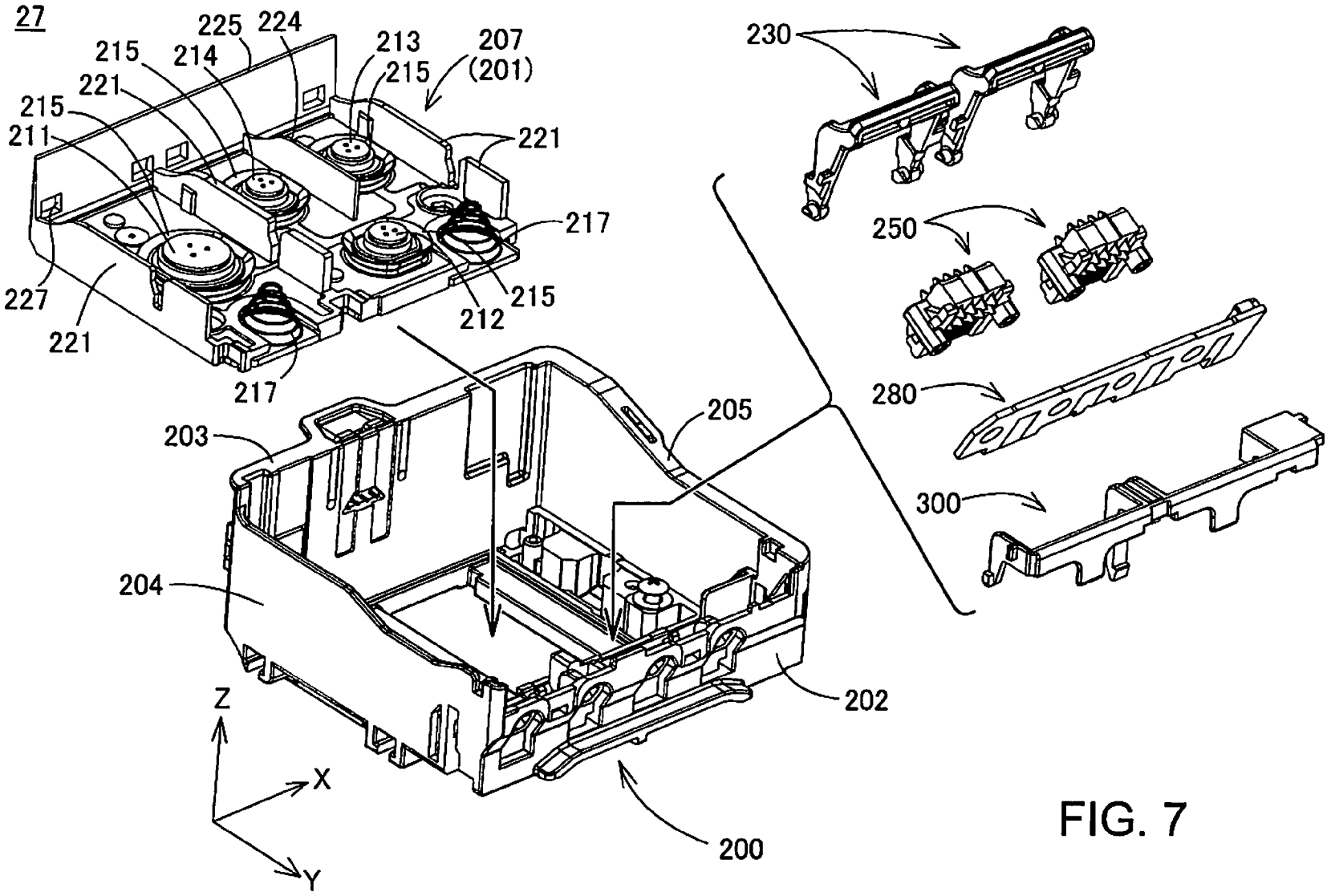
FIG. 7 is an exploded perspective view of the cartridge mounting part.

The schematic configuration of the cartridge mounting part 27 will be described with reference to FIGS. 4 to 7. FIG. 4 is a first external perspective view of the cartridge mounting part 27. FIG. 5 is a second external perspective view of the cartridge mounting part 27. FIG. 6 is a third external perspective view of the cartridge mounting part 27. FIG. 7 is an exploded perspective view of the cartridge mounting part 27. The cartridge mounting part 27 (FIG. 4) has a first mounting part 210A and a second mounting part 210B in which the liquid supply unit 100 is to be mounted. A mounting part 210 that includes the first mounting part 210A and the second mounting part 210B is partitioned by five walls 201 to 205. The mounting part 210 including the first mounting part 210A and the second mounting part 210B has a recessed shape that is open vertically upward. The first mounting part 210A and the second mounting part 210B are separated by a partition wall 221A that has slits 223. That is, the partition wall 221A is disposed between the first mounting part 210A and the second mounting part 210B.

A bottom wall 201 constitutes the bottom surface of the mounting part 210. More precisely, the bottom wall 201 constitutes a bottom surface whose outer shape is substantially rectangular. On the bottom wall 201 are a plurality of partition walls 221 that rise from the bottom surface. Of the plurality of partition walls 221, the partition wall located between the first mounting part 210A and the second mounting part 210B is given the reference sign "221A".

The four walls 202 to 205 are walls that rise vertically upward from the periphery of the bottom wall 201. A front wall 202 and a back wall 203 respectively extend substantially vertically upward from the edge on the front side and the edge on the back side of the bottom wall 201. The front wall 202 and the back wall 203 constitute the front surface and the back surface of the mounting part 210. A first side wall 204 and a second side wall 205 respectively extend substantially vertically upward from the left side end and the right side end of the bottom wall 201. The first side wall 204 and the second side wall 205 constitute the left side surface and right side surface of the mounting part 210.

In this embodiment, the front wall 202, the back wall 203, the first side wall 204 and the second side wall 205 are constituted by respective side walls of the carriage unit 200, which has a substantially square tubular shape formed by integral molding (FIG. 7). Also, the bottom wall 201 is constituted by a head unit 207 that is formed separately to the carriage unit 200, and is disposed in a bottom side opening of the carriage unit 200. Two engaging parts 230, two connector units 250, a wiring board 280 and a cover member 300 are integrally assembled and attached to the front wall 202 of the carriage unit 200.

The two engaging parts 230 each have the same configuration, and are arranged side-by-side in the direction of the arrow X (FIGS. 4 to 6). The two engaging parts 230 function as levers that are used when attaching and detaching the liquid supply unit 100 to and from the cartridge mounting part 27. Of the two engaging parts 230, the engaging part provided in the first mounting part 210A is also called a first engaging part 230A, and the engaging part provided in the second mounting part 210B is also called a second engaging part 230B. The engaging parts 230A and 230B are both attached to the front wall 202 so as to be turnable in the direction of the arrow Y. The engaging parts 230 engage engagement parts of the liquid supply unit 100 by turning movement (discussed in detail later). Note that, in this specification, "to engage" means to engage a predetermined part of an object such that the movement direction of the object is restricted.

The two connector units 250 each have the same configuration, and are respectively arranged downward of a different one of the two engaging parts 230. The connector units 250 have electrode parts that are electrically connectable to a circuit board (discussed later) of the liquid supply unit 100. Of the two connector units 250, the connector unit provided in the first mounting part 210A is also called a first connector unit 250A, and the connector unit provided in the second mounting part 210B is also called a second connector unit 250B.

The wiring board 280 electrically connects the connector units 250A and 250B to an electrical system of the printing apparatus 10. The cover member 300 is disposed between the wiring board 280 and the front wall 202, and holds the engaging parts 230, the connector units 250 and the wiring board 280 together from the front wall 202 side.

The abovementioned print head 190 is attached to the lower surface of the bottom wall 201 (FIG. 6). Liquid introduction parts 211 to 214 are provided on the upper surface of the bottom wall 201 (FIG. 4, FIG. 5). Of the liquid introduction parts 211 to 214, the liquid introduction part 211 provided in the first mounting part 210A is also called a first liquid introduction part 211, and the liquid introduction parts 212 to 214 provided in the second mounting part 210B are also called second liquid introduction parts 212 to 214. The first liquid introduction part 211 is connected to a liquid supply part that is provided in the liquid supply unit 100, and ink housed in the liquid supply unit 100 is supplied thereto. The ink supplied to the first liquid introduction part 211 is introduced to the ink channel of the print head 190. A seal 215 is provided on the periphery of each of the liquid introduction parts 211 to 214. The seal 215 suppresses infiltration of outside air into the path of the ink, together with suppressing leakage of ink to the outside.

The second liquid introduction parts 212 to 214 are not connected to the liquid supply unit 100, and thus ink housed in the liquid supply unit 100 is not supplied thereto. On the other hand, the cartridge mounting part 27 may have mounted therein a liquid supply unit (first cartridge) housing black ink that is mounted in only the first mounting part 210A and a liquid supply unit (second cartridge) housing color ink (cyan, yellow, magenta) that is mounted in only the second mounting part 210B. In this case, the second cartridge is provided with a liquid supply part that supplies cyan ink, a liquid supply part that supplies yellow ink and a liquid supply part that supplies magenta ink, and is connected to the second liquid introduction parts 212 to 214 to which these three liquid supply parts correspond.

A biasing mechanism 217 is provided on the bottom wall 201. The biasing mechanism 217 biases the liquid supply unit 100 that is placed on the bottom wall 201 in a direction (upward) away from the bottom wall 201. In this embodiment, the biasing mechanism 217 is constituted by a helical spring. As a result of the biasing mechanism 217, the fixity of the liquid supply unit 100 to the cartridge mounting part 27 is improved, and operability at the time of removing the liquid supply unit 100 is improved.

The bottom wall 201 has provided thereon a first auxiliary wall 221 and a second auxiliary wall 224 whose height from the bottom wall 201 is lower than the first side wall 204 and the second side wall 205. The first auxiliary wall 221 and the second auxiliary wall 224 are parallel to the first side wall 204 and the second side wall 205. The first auxiliary wall 221 is disposed adjacent to the first side wall 204 and the second side wall 205, and between the first mounting part 210A and the second mounting part 210B. Here, the first auxiliary wall 221 disposed between the first mounting part 210A and the second mounting part 210B is also called a "partition wall 221A". The partition wall 221A separates the first mounting part 210A and the second mounting part 210B. The partition wall 221A has a slit (notch) 223 extending from an upper edge surface thereof to the bottom wall 201. The slit 223 is formed partway along the partition wall 221A that extends in the Y direction. In this embodiment, two slits 223 are provided. The first auxiliary walls 221 function as positioning parts that position the liquid supply unit 100 with respect to the cartridge mounting part 27. The first auxiliary walls 221 and the second auxiliary wall 224 also function as impact prevention parts that prevent the corners of the liquid supply unit 100 from impacting against the liquid introduction parts 211 to 214.

On the bottom wall 201, a third auxiliary wall 225 extending parallel to the back wall 203 is provided at a position adjacent to the back wall 203. In the lower edge of the third auxiliary wall 225, a plurality of fitting holes 227 are arrayed in the direction of the arrow X. When the liquid supply unit 100 is mounted, two projections that are provided on the lower edge of the liquid supply unit 100 are inserted through the two fitting holes 227 that are located on either side in the X direction.

In addition, on the bottom wall 201, a partition wall 228 projecting toward the lower edge of the connector units 250 is provided between the mounting part 210 and the disposition region of the wiring board 280 (FIG. 5). Also, in the bottom wall 201, a through hole 229 is provided downward of the wiring board 280 (FIG. 6). The through hole 229 is disposed above the guide rail 28 of the printing apparatus 10.

Figure 8:
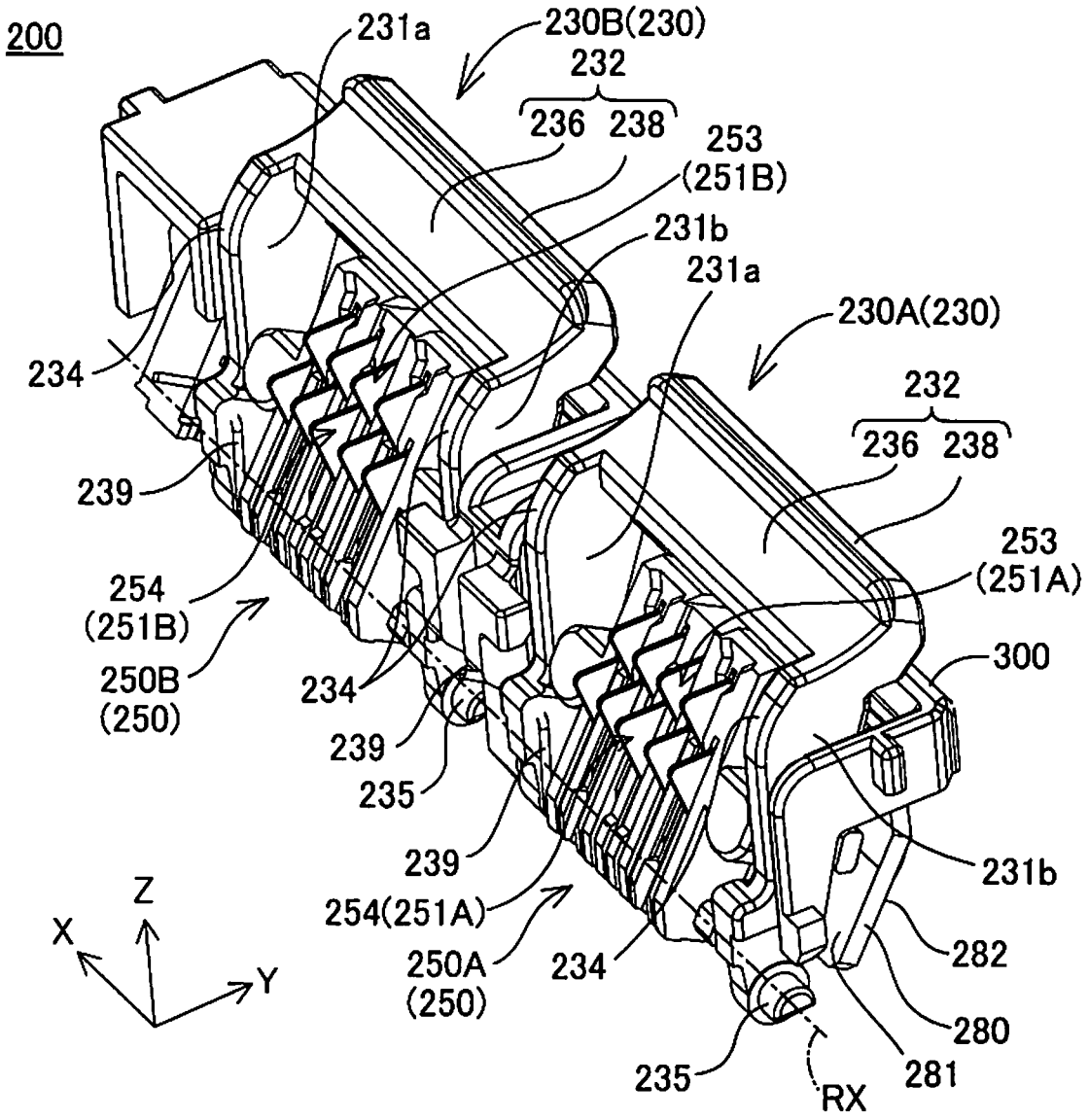
FIG. 8 is a perspective view of an engaging part, a connector unit and a wiring board in a state of being attached to a front wall of a carriage unit.
Figure 9:
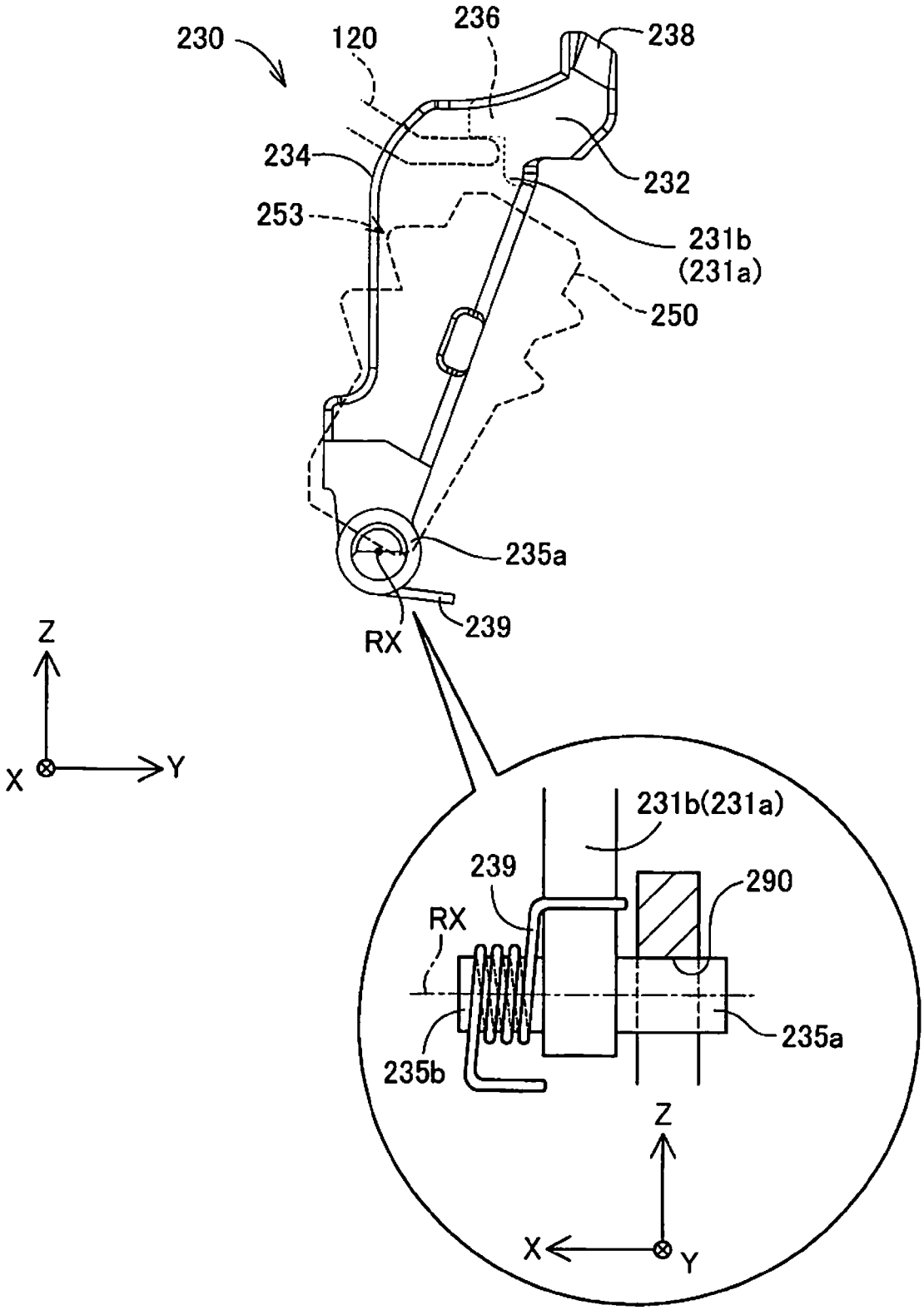
FIG. 9 is a side view of the engaging part when seen in a direction of an arrow X.

Description of the engaging parts 230 and the connector units 250 will be given below using FIGS. 8 and 9. FIG. 8 is a perspective view of the engaging parts 230, the connector units 250 and the wiring board 280 in a state of being attached to the front wall 202 of the carriage unit 200. FIG. 9 is a side view of the engaging parts 230 when seen in the direction of the arrow X. A turning axis RX of the engaging parts 230 is illustrated in both FIGS. 8 and 9. In FIG. 9, the disposition region of the connector units 250 in the carriage unit 200, and the disposition region of the engagement mechanism 120 of the liquid supply unit 100 when the liquid supply unit 100 is mounted in the carriage unit 200 are illustrated with broken lines. Also, in FIG. 9, a blow-up of the attachment structure at the end of a second leg 231*b* of the engaging parts 230 is shown inside the balloon.

The engaging parts 230 have a rectangular frame shape that is open downward, and have first and second legs 231*a* and 231*b* and a main part 232. The first and second legs 231*a* and 231*b* extend in the direction of the arrow Z from the bottom wall 201. The first and second legs 231*a* and 231*b* have substantially the same shape, and are arrayed parallel to the direction of the arrow X. The main part 232 is a part that extends in the direction of the arrow X, and is connected to the upper end of the first and second legs 231*a* and 231*b*.

A first raised part 235*a* and a second raised part 235*b* respectively projecting toward the outside and toward the inside in the direction of the arrow X are provided on the lower end of the legs 231*a* and 231*b* of the engaging parts 230 (FIG. 9). The engaging parts 230 are attached by the first raised part 235*a* of the legs 231*a* and 231*b* fitting into fitting holes 290 provided in the lower edge of the front wall 202 (inside the balloon in FIG. 9). The engaging parts 230 are thereby turnable in the back-front direction about the central axis of the respective first raised parts 235*a* as the turning axis RX.

A biasing mechanism 239 is provided at the lower end of the legs 231*a* and 231*b*. In this embodiment, the biasing mechanism 239 is constituted by a torsion spring, and is attached to the second raised part 235*b* of the legs 231*a* and 231*b*. The engaging parts 230 are locked by the biasing mechanism 239 so as to be stationary at a predetermined turning angle in a state of being biased toward the mounting part 210. The engaging parts 230, after having been turned by an external force acting in a direction away from the mounting part 210, return to the above initial position due to the biasing force of the biasing mechanism 239, when this external force is released.

The main part 232 has an abutting part 236 and an operation part 238. The abutting part 236 is located at the end of the main part 232 on the side in the opposite direction of the arrow Y (end on the mounting part 210 side). At least a portion on the lower side of the end of the abutting part 236 on the mounting part 210 side abuts against at least a portion of the engagement part (discussed later) of the liquid supply unit 100. As a result of the abutting of the abutting part 236, the engagement mechanism 120 of the liquid supply unit 100 is engaged in the direction of the arrow Z. The direction of the arrow Z is a direction from the liquid introduction part 211 toward the liquid supply part of the liquid supply unit 100. As a result of this abutting, the engagement mechanism 120 of the liquid supply unit 100 is restricted from moving in a direction away from the carriage unit 200.

In this embodiment, the direction of the arrow Z coincides with the direction of engagement in which the main part 232 of the engaging parts 230 engages the engagement mechanism 120 of the liquid supply unit 100. The "direction of engagement" in this specification means the direction in which the object to be engaged is engaged, and the direction in which movement is restricted by engagement with that object, and can also be interpreted as being the direction in which an engaging force is produced with respect to the object to be engaged.

The operation part 238 is a part that is located at the edge of the main part 232 on the side in the direction of the arrow Y (front side), and bends upward from the abutting part 236. The user is able to easily turn the engaging parts 230 forward by placing a fingertip on the operation part 238 and pulling.

The legs 231*a* and 231*b* are configured so as to be substantially tabular, and are disposed parallel to a plane that is defined by the directions of the arrows Y and Z. The width of the legs 231*a* and 231*b* in the direction of the arrow Y increases toward the upper side from the lower end that serves as the turning axis. In the legs 231*a* and 231*b*, an extension part 234 that extends such that a peripheral edge approaches the mounting part 210 (FIG. 5) is formed in an upward part close to the main part 232.

Here, the connector units 250 are disposed between the first and second legs 231*a* and 231*b* (FIG. 9). The connector units 250 are fixed to the front wall 202 of the carriage unit 200 independently to the engaging parts 230, in a state of having an angle of inclination (e.g., 10 to 45 degrees with respect to the direction of the arrow Z) corresponding to the circuit board (discussed later) of the liquid supply unit 100.

With regard to the extension part 234 of the engaging parts 230, in an initial state in which the liquid supply unit 100 is not mounted in the carriage unit 200, the peripheral edge thereof is in a position closer to the mounting part 210 than is an upper electrode part 253 (discussed later) of the connector units 250. Also, the extension part 234 extends upward (direction of the arrow Z), which is the mounting direction of the liquid supply unit 100. As a result of the extension part 234, the adherence of foreign matter such as oily secretion due to the user's fingertips contacting the upper electrode part 253 can be suppressed.

As shown in FIG. 8, the first connector unit 250A has a first electrode part 251A located on the lower side of the abutting part 236. The second connector unit 250B has a second electrode part 251B located on the lower side of the abutting part 236. The first and second electrode parts 251A and 251B are both constituted by a plurality of terminals (nine terminals in this embodiment). The plurality of terminals are formed by a metal plate. Of the plurality of terminals that are provided in the first and second electrode parts 251A and 251B, the group of terminals forming a row in the X direction at a position on the upper side is also called an upper electrode part 253, and the group of terminals forming a row in the X direction at a position of the lower side of the upper electrode part 253 is also called a lower electrode part 254. Portions of the first and second electrode parts 251A and 251B are electrically connected by contacting the wiring board 280. The wiring board 280 is electrically connected to the controller 21 via a distribution cable.

A-3. External Configuration of Liquid Supply Unit

Figure 10:
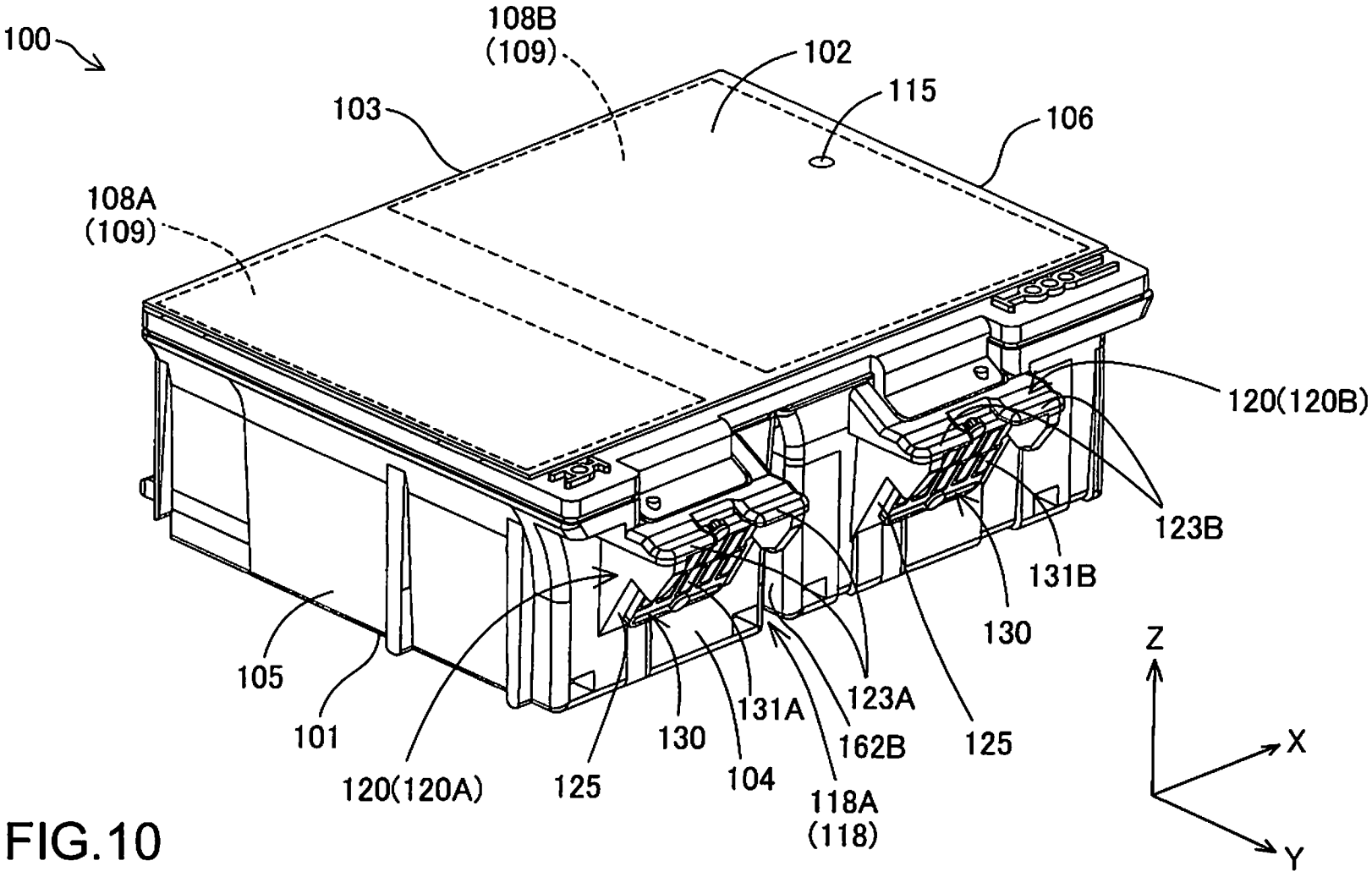
FIG. 10 is a first external perspective view of the liquid supply unit.
Figure 11:
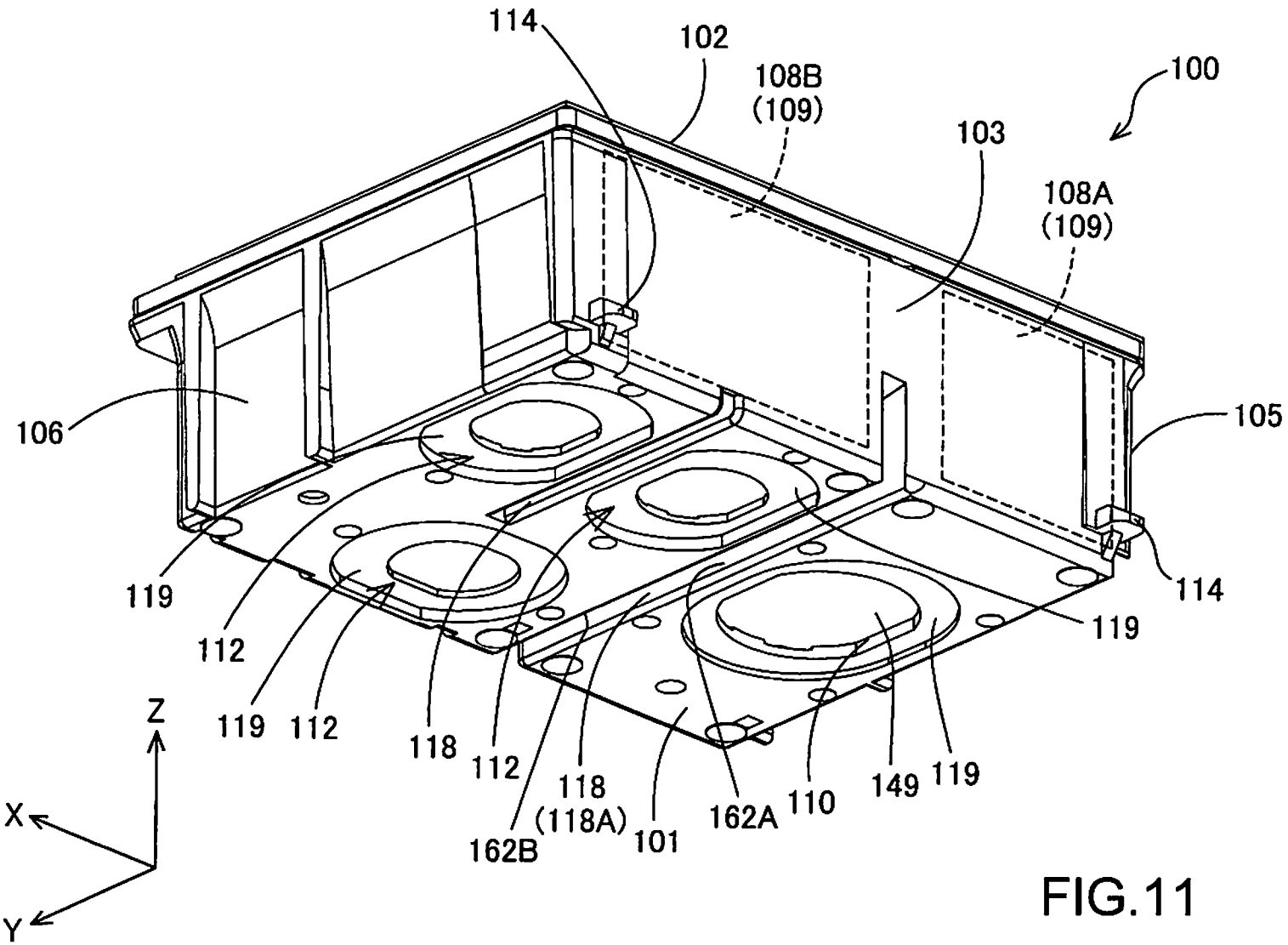
FIG. 11 is a second external perspective view of the liquid supply unit.
Figure 12A:
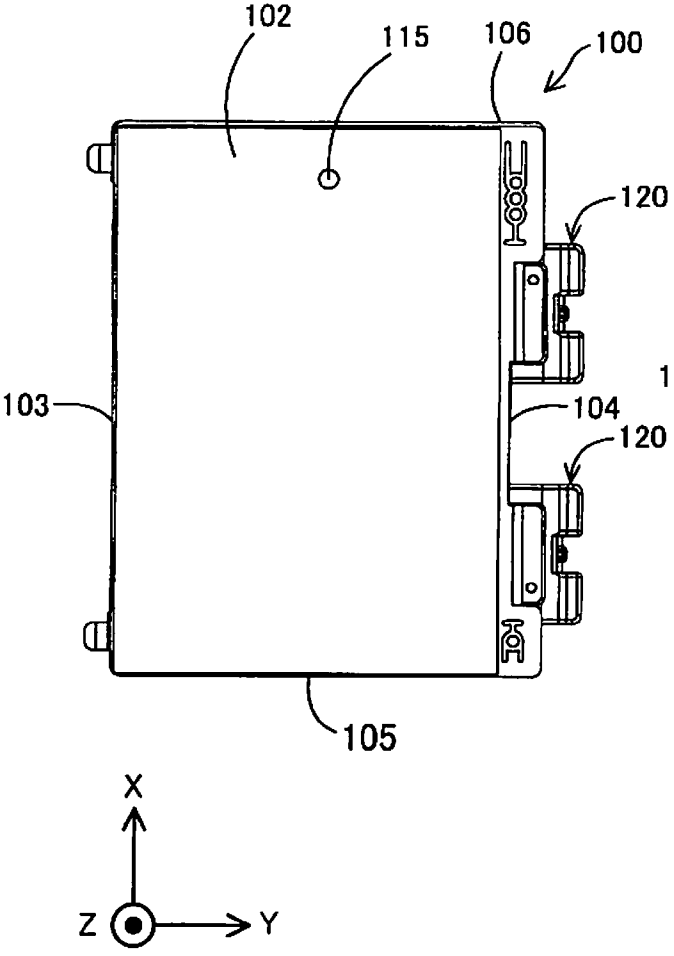
FIGS. 12A to 12C are diagrams for describing the liquid supply unit.
Figure 12B:
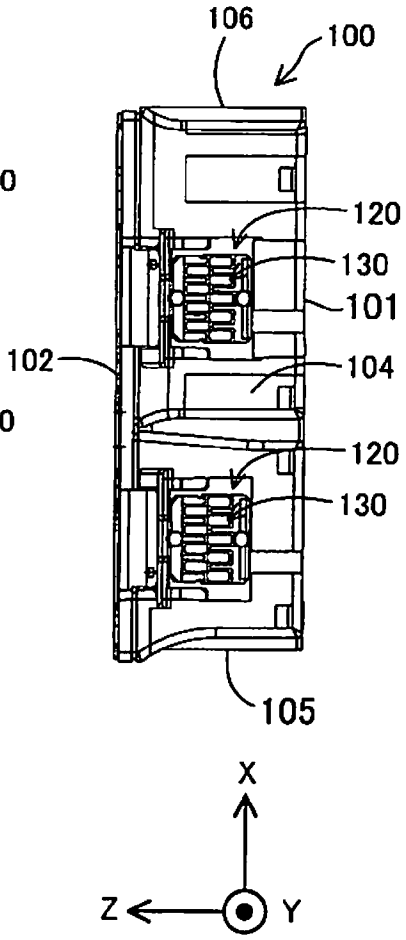
Figure 12C:
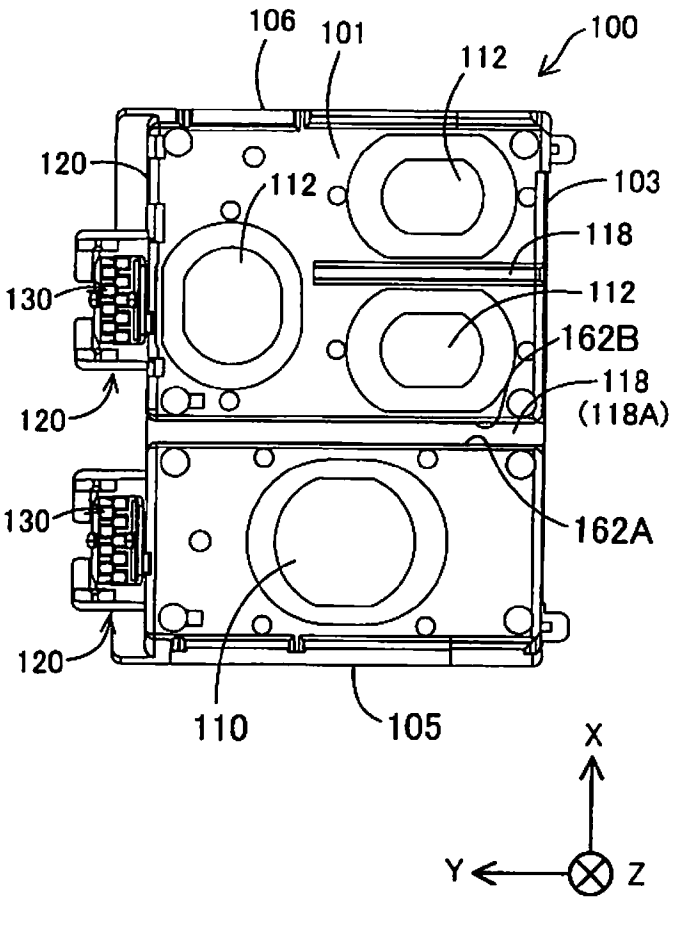

FIG. 10 is a first external perspective view of the liquid supply unit 100. FIG. 11 is a second external perspective view of the liquid supply unit 100. FIGS. 12A to 12C are diagrams for describing the liquid supply unit 100. FIG. 12A is an top view of the liquid supply unit 100. FIG. 12B is a front view of the liquid supply unit 100. FIG. 12C is a bottom view of the liquid supply unit 100. In FIGS. 10 to 12, arrows X, Y and Z in the mounted state in which the printing apparatus 10 is mounted in the liquid supply unit 100 are illustrated. Note that the arrows X, Y and Z in the mounted state are also similarly illustrated in the following diagrams if required.

The liquid supply unit 100 (FIG. 10) has a substantially rectangular parallelepiped outer shape. The liquid supply unit 100 has six walls 101 to 106 constituting an outer shell. The outer shell is formed by a synthetic resin such as polyethylene or polystyrene. A liquid housing space 109 that includes a liquid housing chamber for housing ink is formed in the inner part enclosed by the six walls 101 to 106. In other words, the liquid housing space 109 for housing ink is formed inside the liquid supply unit 100. The wall 101 is also called a first wall (bottom wall) 101. The wall 102 is also called a second wall (upper wall). The wall 103 is also called a third wall (back wall) 103. The wall 104 is also called a fourth wall (front wall) 104. The wall 105 is also called a fifth wall (left wall) 105. The wall 106 is also called a sixth wall (right wall) 106.

In the mounted state, the first wall 101 and the second wall 102 each constitute a substantially horizontal wall, and the third to sixth walls 103 to 106 each constitute a substantially perpendicular wall.

The first wall 101 (FIG. 11) constitutes a bottom surface opposing the bottom wall 201 (FIG. 4), when the liquid supply unit 100 is in the mounted state of being mounted in the cartridge mounting part 27. Two gaps 118 receive the partition walls 221 projecting from the bottom wall 201 in the mounted state. Two gaps 118 are formed in the first wall 101. These gaps 118 are also called grooves. Of the two gaps 118, the reference sign "118A" is given to the gap which receives the partition wall 221A (FIG. 4). The gaps 118 receive the partition walls 221, when the liquid supply unit 100 is mounted in the cartridge mounting part 27 of the printing apparatus 10. The gap 118A is formed to span from the third wall 103 to the fourth wall 104 (FIG. 12C). Note that the shape of the gaps 118 is not limited to the above, and may be any shape that has sufficient length (size in the Y direction) and depth (size in the Z direction) for the partition walls 221 to be insertable.

The gap 118A can also be defined as follows. That is, the gap 118A is formed between a first outer wall 162A (FIG. 11) that partitions off a first liquid housing chamber (first liquid housing part) 108A, and a second outer wall 162B (FIG. 10) that partitions off a second liquid housing chamber (second liquid housing part) 108B. The first outer wall 162A and the second outer wall 162B oppose each other across the gap 118A. The first outer wall 162A and the second outer wall 162B sandwich the partition wall 221A in the mounted state. The first outer wall 162A and the second outer wall 162B are both walls that intersect the first wall 101 and extend from the first wall 101 toward the second wall 102 side. The first outer wall 162A and the second outer wall 162B can be taken as constituting the side walls of the recessed gap 118A. Also, the gap 118A can be a recessed part (groove) formed in the first wall 101.

As shown in FIG. 10, the liquid supply unit 100 is provided with the first liquid housing chamber 108A and the second liquid housing chamber 108B that are positioned so as to sandwich the gap 118A. The first liquid housing chamber 108A and the second liquid housing chamber 108B constitute the liquid housing space 109. The first liquid housing chamber 108A and the second liquid housing chamber 108B are in communication. The first liquid housing chamber 108A is mountable in the first mounting part 210A (FIG. 4), and the second liquid housing chamber 108B is mountable in the second mounting part 210B. That is, in the mounted state in which the liquid supply unit 100 is mounted in the printing apparatus 10, the first liquid housing chamber 108A is housed in the first mounting part 210A, and the second liquid housing chamber 108B is housed in the second mounting part 210B. Note that the internal configuration of the liquid supply unit 100 including the first liquid housing chamber 108A and the second liquid housing chamber 108B will be discussed later.

A liquid supply part 110 that enables ink to be supplied to the first liquid introduction part 211 (FIG. 4) is formed in the first wall 101 (FIG. 11). Specifically, the liquid supply part 110 is formed in the portion of the first wall 101 that partitions off the first liquid housing chamber 108A. In other words, the first liquid housing chamber 108A has the liquid supply part 110. The liquid supply part 110 is an opening (through hole) formed in the first wall 101. The liquid supply part 110 is in communication with the interior space (space housing the liquid) of the first liquid housing chamber 108A. Inside the first liquid housing chamber 108A, a supply part side liquid holding member 149 is disposed so as to close the liquid supply part 110. The supply part side liquid holding member 149 is a member for holding ink. The supply part side liquid holding member 149 may be any member that allows the ink to circulate to the first liquid introduction part 211 when a predetermined external force (suction force from the printing apparatus 10) is applied, while holding the ink. The supply part side liquid holding member 149 may, for example, be foam formed with polyurethane or the like, or a fiber member obtained by bundling processed polypropylene fibers.

In the mounted state, the tip side portion of the first liquid introduction part 211 is inserted inside the liquid supply part 110, and the tip of the first liquid introduction part 211 contacts the supply part side liquid holding member 149. The ink held by the supply part side liquid holding member 149 circulates to the first liquid introduction part 211 due to the inside of the first liquid housing chamber 108A being suctioned by a pump mechanism (not shown) of the printing apparatus 10 via the first liquid introduction part 211. Ink is thereby supplied from the liquid supply unit 100 to the printing apparatus 10.

In the first wall 101, a step 119 whose outer shape is similar to the outer shape of the liquid supply part 110 is formed on the periphery of the liquid supply part 110. The step 119 is a portion obtained by recessing the outer surface the first wall 101. In the mounted state, the seal 215 abuts against the step 119. Leaking of ink beyond the seal 215 is thereby suppressed.

Three recessed parts 112 are further formed in the first wall 101. Specifically, the three recessed parts 112 are formed in a portion of the first wall 101 that partitions off the second liquid housing chamber 108B. In other words, the second liquid housing chamber 108B has the recessed parts 112. In the mounted state, the corresponding second liquid introduction parts 212 to 214 (FIG. 4) are inserted in the three recessed parts 112. The three recessed parts 112 have a bottom (surface on the +Z direction side) and do not pass through the first wall 101. The three recessed parts 112 have sufficient depth for the tips (ends on the +Z direction side) of the corresponding second liquid introduction parts 212 to 214 to not come in contact therewith in the mounted state. Each of the three recessed parts 112 has a step 119 on the periphery thereof. The steps 119 are located further on the first wall 101 surface side than are the bottoms of the recessed parts 112. In the mounted state, the seals 215 abut against the steps 119. Note that as long as ink that is on the tips of the second liquid introduction parts 212 to 214 does not adhere to the liquid supply unit 100 in the mounted state, the first wall 101 need not be provided with the recessed parts 112, and the depth of the recessed parts 112 is not limited to the above. For example, by disposing covers that cover the tips of the second liquid introduction parts 212 to 214 in the case of mounting the liquid supply unit 100 in the cartridge mounting part 27, a configuration may be adopted in which the recessed parts 112 are omitted or the recessed parts 112 have sufficient depth to come in contact with the covers.

The second wall 102 opposes the first wall 101 across the inside of the first liquid housing chamber 108A and the inside of the second liquid housing chamber 108B. The second wall 102 constitutes the upper surface of the liquid supply unit 100. The second wall 102 is a single wall that partitions off the first liquid housing chamber 108A and the second liquid housing chamber 108B. An atmosphere communication passage 115 for introducing the outside air into the second liquid housing chamber 108B with the consumption of ink in the liquid housing space 109 is formed in the second wall 102 (FIG. 10). The atmosphere communication passage 115 is an opening (through hole) formed in the portion of the second wall 102 that partitions off the second liquid housing chamber 108B.

The third wall 103 (FIG. 11) intersects the first wall 101 and the second wall 102. The third wall 103 constitutes the back surface of the liquid supply unit 100. Two projections 114 that are inserted into the two fitting holes 227 (FIG. 4) in the mounted state are provided in the third wall 103.

The fourth wall 104 (FIG. 10) intersects the first wall 101 and the second wall 102. Also, the fourth wall 104 opposes the third wall 103 across the inside of the first liquid housing chamber 108A and the inside of the second liquid housing chamber 108B. Two engagement mechanisms 120 are provided on the fourth wall 104. The two engagement mechanisms 120 are walls projecting from the fourth wall 104. Of the two engagement mechanisms 120, the engagement mechanism that is located on the first liquid housing chamber 108A side with respect to the gap 118A is also called a first engagement mechanism 120A, and the engagement mechanism that is located on the second liquid housing chamber 108B side with respect to the gap 118A is also called a second engagement mechanism 120B. Since the configurations of the first engagement mechanism 120A and the second engagement mechanism 120B are the same, engagement mechanisms 120 is used in the case not distinguishing therebetween.

The first engagement mechanism 120A has a first engagement part 123A that engages with the first engaging part 230A (FIG. 8) in the mounted state. The first engagement part 123A is a tabular member projecting outward from the fourth wall 104. In the mounted state, the first engagement part 123A is positioned directly under the abutting part 236 of the first engaging part 230A. Also, in the mounted state, the first engagement part 123A engages with the first engaging part 230A by abutting against the abutting part 236 of the first engaging part 230A in a direction (+Z direction) toward the liquid supply part 110 from the first liquid introduction part 211.

The first engagement mechanism 120A further has a terminal disposition surface 125 located further on the first wall 101 side than are the first engagement part 123A. The terminal disposition surface 125 inclines so as to approach the fourth wall 104 as it approaches the first wall 101 side (i.e., toward the vertically lower side). A circuit board 130 is disposed on the terminal disposition surface 125. The circuit board 130 has, on the front surface thereof, first terminals 131A that are electrically connectable to the first electrode part 251A (FIG. 8). Nine first terminals 131A are disposed in correspondence with the number of terminals of the first electrode part 251A. Also, the circuit board 130 has a storage (not shown) on the back surface thereof. Various information (e.g., amount of remaining ink and ink color) relating to the liquid supply unit 100 is stored in the storage. In the mounted state, signals can be exchanged between the storage of the circuit board 130 and the controller 21, due to the first terminals 131A and the first electrode part 251A coming in contact and becoming electrically connected.

The second engagement mechanism 120B has a second engagement part 123B that engages with the second engaging part 230B (FIG. 8) in the mounted state. The second engagement part 123B is a tabular member projecting outward from the fourth wall 104. In the mounted state, the second engagement part 123B is located directly under the abutting part 236 of the second engaging part 230B. Also, in the mounted state, the second engagement part 123B engages with the second engaging part 230B by abutting against the abutting part 236 of the second engaging part 230B in a direction (+Z direction) toward the liquid supply part 110 from the first liquid introduction part 211.

The second engagement mechanism 120B further has a terminal disposition surface 125 located further on the first wall 101 side than are the second engagement part 123B. The terminal disposition surface 125 inclines so as to approach the fourth wall 104 as it approaches the first wall 101 side (i.e., moving vertically downward). A circuit board 130 is disposed on the terminal disposition surface 125. The circuit board 130 has, on a front surface thereof, second terminals 131B that are electrically connectable to the second electrode part 251B (FIG. 8). Nine second terminals 131B are disposed in correspondence with the number of terminals of the second electrode part 251B. Also, the circuit board 130 has a storage (not shown) on the back surface thereof. Various information (e.g., amount of ink remaining and ink color) relating to the liquid supply unit 100 is stored in the storage. In the mounted state, signals can be exchanged between the storage of the circuit board 130 and the controller 21, due to the second terminals 131B and the second electrode part 251B coming in contact and becoming electrically connected.

The fifth wall 105 (FIG. 10) intersects the first to fourth walls 101 to 104. The sixth wall 106 (FIG. 11) intersects the first to fourth walls 101 to 104. The fifth wall 105 and the sixth wall 106 oppose each other across the inside of the first liquid housing chamber 108A and the inside of the second liquid housing chamber 108B.

The first to fourth walls 101 to 104 partition off the first liquid housing chamber 108A and the second liquid housing chamber 108B. The fifth wall 105 partitions off the first liquid housing chamber 108A, and does not partition off the second liquid housing chamber 108B. The sixth wall 106 partitions off the second liquid housing chamber 108B, and does not partition off the first liquid housing chamber 108A.

A-4. Detailed Configuration of Liquid Supply Unit

Figure 13:
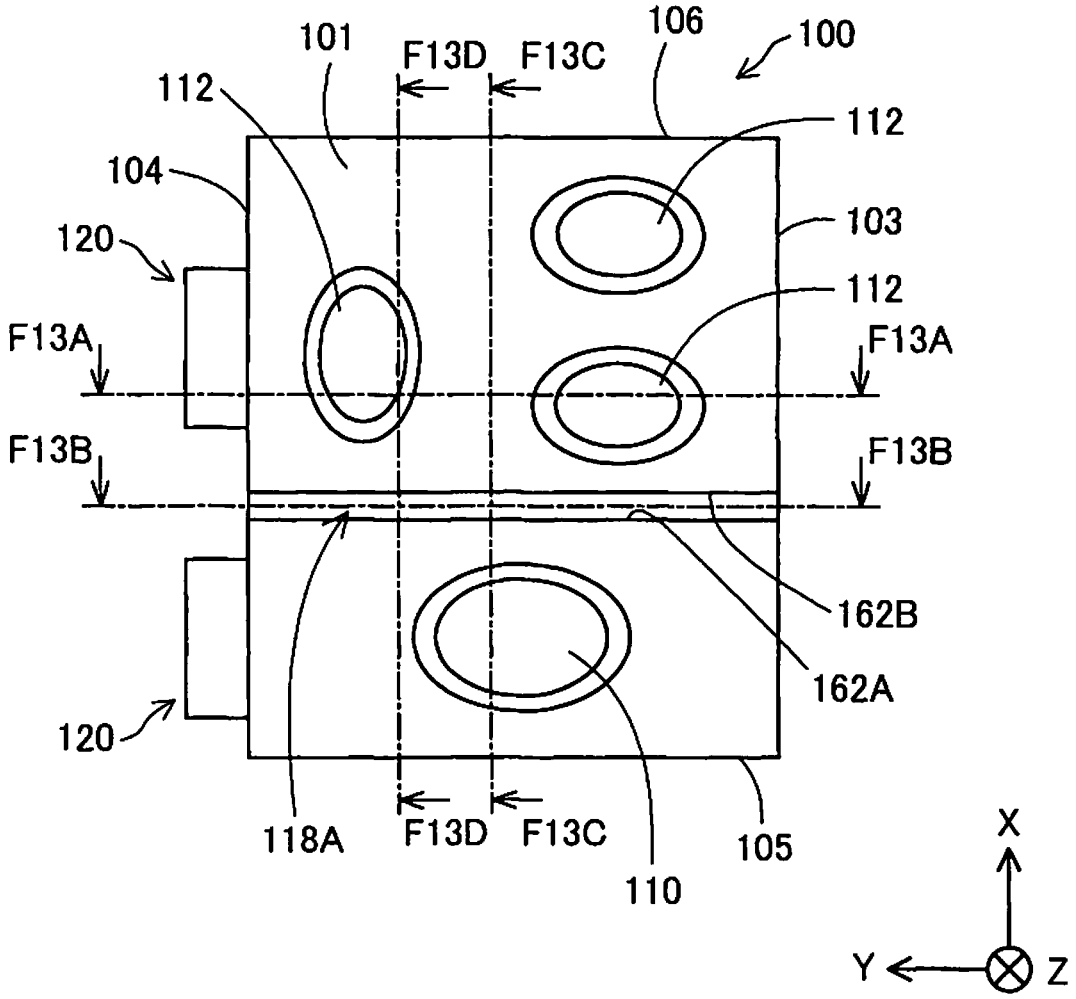
FIG. 13 is a bottom view of the liquid supply unit.
Figure 14B:
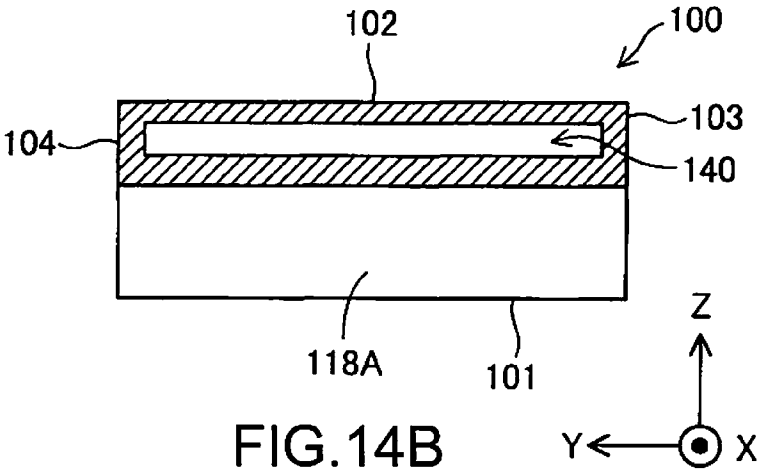
FIGS. 14A to 14D are diagrams for describing the liquid supply unit.
Figure 14A:
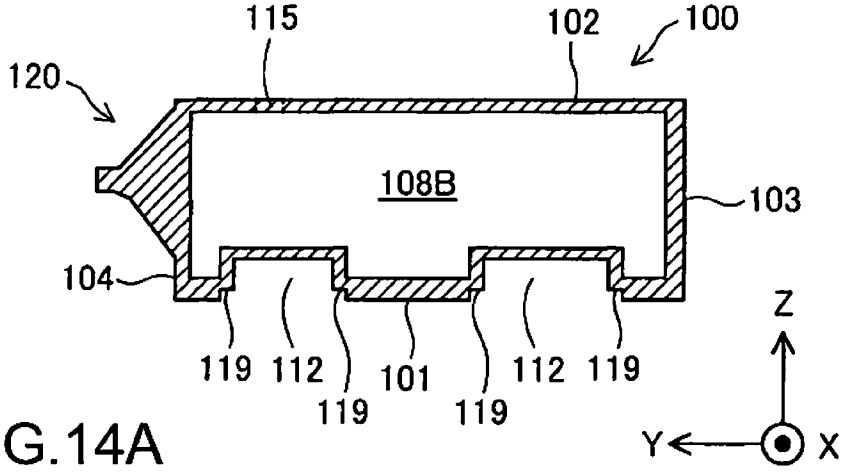
Figure 14D:
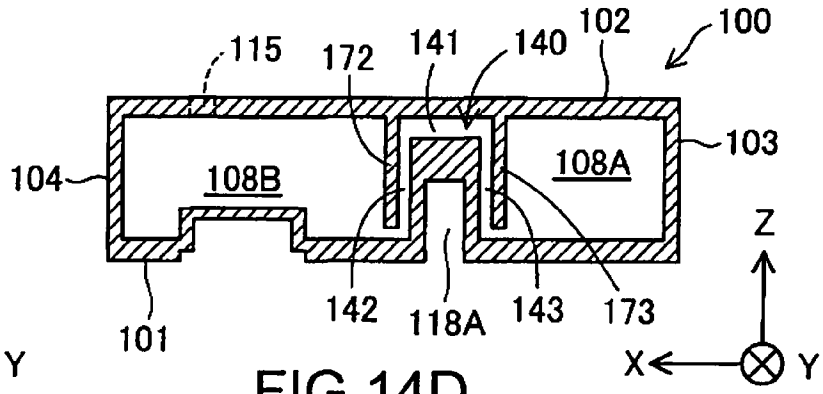
Figure 14C:
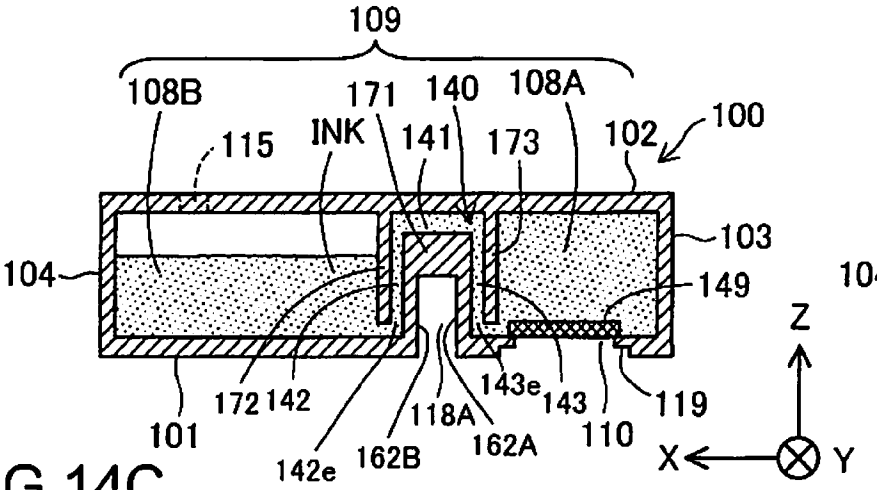
Figure 15:
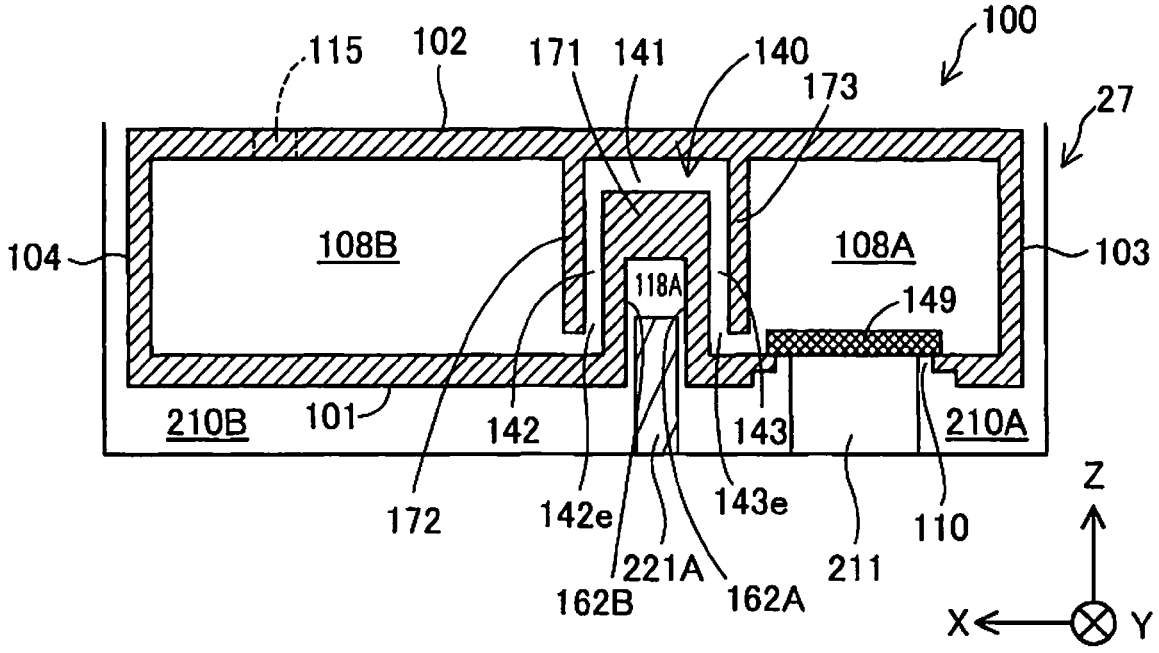
FIG. 15 is a diagram for describing the liquid supply unit in the mounted state.

FIG. 13 is a bottom view of the liquid supply unit 100. FIGS. 14A to 14D are diagrams for describing the liquid supply unit 100. FIG. 15 is a diagram for describing the liquid supply unit 100 in the mounted state. FIG. 14A is a cross-sectional view along F13A-F13A in FIG. 13. FIG. 14B is a cross-sectional view along F13B-F13B in FIG. 13. FIG. 14C is a cross-sectional view along F13C-F13C in FIG. 13. FIG. 14D is a cross-sectional view along F13D-F13D in FIG. 13. Note that FIGS. 13 and 14A to 14D are schematic diagrams of the liquid supply unit 100, and mainly illustrate configuration that is required for description.

As shown in FIG. 14C, the liquid supply unit 100 has a liquid communication part 140 that communicates with the first liquid housing chamber 108A and the second liquid housing chamber 108B. One end 143*e* of the liquid communication part 140 is open within the first liquid housing chamber 108A. The other end 142*e* of the liquid communication part 140 is open within the second liquid housing chamber 108B. The liquid communication part 140 has a first liquid channel 141, a second liquid channel 142, and a third liquid channel 143. In the direction of ink flow from the second liquid housing chamber 108B toward the first liquid housing chamber 108A, the second liquid channel 142, the first liquid channel 141 and the third liquid channel 143 are disposed in order from the upstream side. The channel direction (flow direction of liquid) differs for each of the first to third liquid channels 141 to 143. The channel direction of the first liquid channel 141 is the horizontal and from the second liquid housing chamber 108B toward the first liquid housing chamber 108A. The channel direction of the second liquid channel 142 is from the first wall 101 toward the second wall 102 (vertically upward). The channel direction of the third liquid channel 143 is from the second wall 102 toward the first wall 101 (vertically downward).

The first liquid channel 141 is sandwiched and partitioned off by the second wall 102 and a first channel wall 171 that constitutes the bottom surface of the recessed gap 118A. The second liquid channel 142 is sandwiched and partitioned off by the second outer wall 162B and a first partition wall 172 that extends from the second wall 102 toward the first wall 101. The third liquid channel 143 is sandwiched and partitioned off by the first outer wall 162A and a second partition wall 173 that extends from the second wall 102 toward the first wall 101. The first partition wall 172 and the second partition wall 173 are both tabular walls that extend from the third wall 103 to the fourth wall 104.

As shown in FIG. 15, when the liquid supply unit 100 is seen in plan view looking in the downward direction in which the upper wall 101 faces the bottom wall 102 in the mounted state, the first liquid channel 141 overlaps with the partition wall 221A. In this embodiment, the first liquid channel 141 is located directly above the partition wall 221A in the mounted state. Also, when the liquid supply unit 100 is seen in plan view looking in the downward direction (vertically downward) in the mounted state, the second liquid channel 142 overlaps with the second mounting part 210B. In other words, in the mounted state, the second liquid channel 142 is located within the second mounting part 210B. Also, when the liquid supply unit 100 is seen in plan view looking in the downward direction, the third liquid channel 143 overlaps with the first mounting part 210A. That is, in the mounted state, the third liquid channel 143 is located within the first mounting part 210A.

As shown in FIG. 14C, the first liquid channel 141 is provided in a position closer to the second wall 102 than to the first wall 101. In other words, the first liquid channel 141 is provided between the second wall 102 and the middle of the first wall 101 and the second wall 102, with regard to the direction (Z direction) in which the first wall 101 and the second wall 102 oppose each other. In this embodiment, the first liquid channel 141 is adjacent to the second wall 102. Also, a first end (the other end) 142*e* of the second liquid channel 142 that is connected to the second liquid housing chamber 108B is provided in a position closer to the first wall 101 than to the first liquid channel 141. In other words, in the mounted state, the first end 142*e* is positioned on the vertically lower side of the first liquid channel 141. Also, a second end (the one end) 143*e* of the third liquid channel 143 that is connected to the first liquid housing chamber 108A is provided in a position closer to the first wall 101 than to the first liquid channel 141. In other words, in the mounted state, the second end 143*e* is provided in a position closer to the first wall 101 than to the first liquid channel 141. The first end 142*e* and the second end 143*e* are both provided in positions closer to the first wall 101 than to the second wall part 102.

As shown in FIG. 15, in the mounted state, the tip (upper end) of the liquid introduction part 211 is inserted into the liquid supply part 110 and contacts the supply part side liquid holding member 149. Ink housed in the first liquid housing chamber 108A thereby circulates to the liquid introduction part 211 via the liquid supply part 110. Atmosphere is introduced to the second liquid housing chamber 108B from the atmosphere communication passage 115 with the consumption of ink in the first liquid housing chamber 108A. Also, in the mounted state, the partition wall 221A is inserted inside the gap 118A.

According to the first embodiment, the liquid supply unit 100 has the gap 118A into which the partition wall 221A is inserted (FIG. 15). The liquid supply unit 100 can thereby be disposed to span the first mounting part 210A and the second mounting part 210B, without the partition wall 221A obstructing the mounting of the liquid supply unit 100 in the cartridge mounting part 27. Ink housed in the second liquid housing chamber 108B that is mountable in the second mounting part 210B can thereby be circulated to the first liquid housing chamber 108A, via the liquid communication part 140, in addition to supplying ink housed in the first liquid housing chamber 108A that is mountable in the first mounting part 210A from the liquid supply part 110 to the liquid introduction part 211. The volume of ink that the liquid supply unit 100 can house can thereby be increased.

Also, according to the above embodiment, the liquid supply unit 100 has the liquid communication part 140 that communicates with the first liquid housing chamber 108A and the second liquid housing chamber 108B (FIG. 15). Ink in the second liquid housing chamber 108B can thereby be circulated to the first liquid housing chamber 108A. Also, the first end 142*e* of the second liquid channel 142 is provided at a position closer to the first wall 101 than to the first liquid channel 141 (FIG. 15). Ink housed in a portion of the second liquid housing chamber 108B that is closer to the first wall 101 than to the first liquid channel 141 can thereby be circulated to the first liquid housing chamber 108A. Also, the second end 143*e* of the third liquid channel 143 is provided in a position closer to the first wall 101 than to the first liquid channel 141 (FIG. 15). Ink housed in the second liquid housing chamber 108B can thereby be circulated to a position of the first liquid housing chamber 108A that is closer to the first wall 101 than to the first liquid channel 141. Also, when the liquid supply unit 100 is seen in plan view looking in the downward direction (vertically downward) from the second wall 102 in the mounted state, the first liquid channel 141 overlaps with the partition wall 221A (FIG. 15). Ink in the second liquid housing chamber 108B can thereby be circulated to the first liquid housing chamber 108A by the liquid communication part 140 that includes the first liquid channel 141, without being obstructed by the partition wall 221A.

B. Second Embodiment

Figure 16:
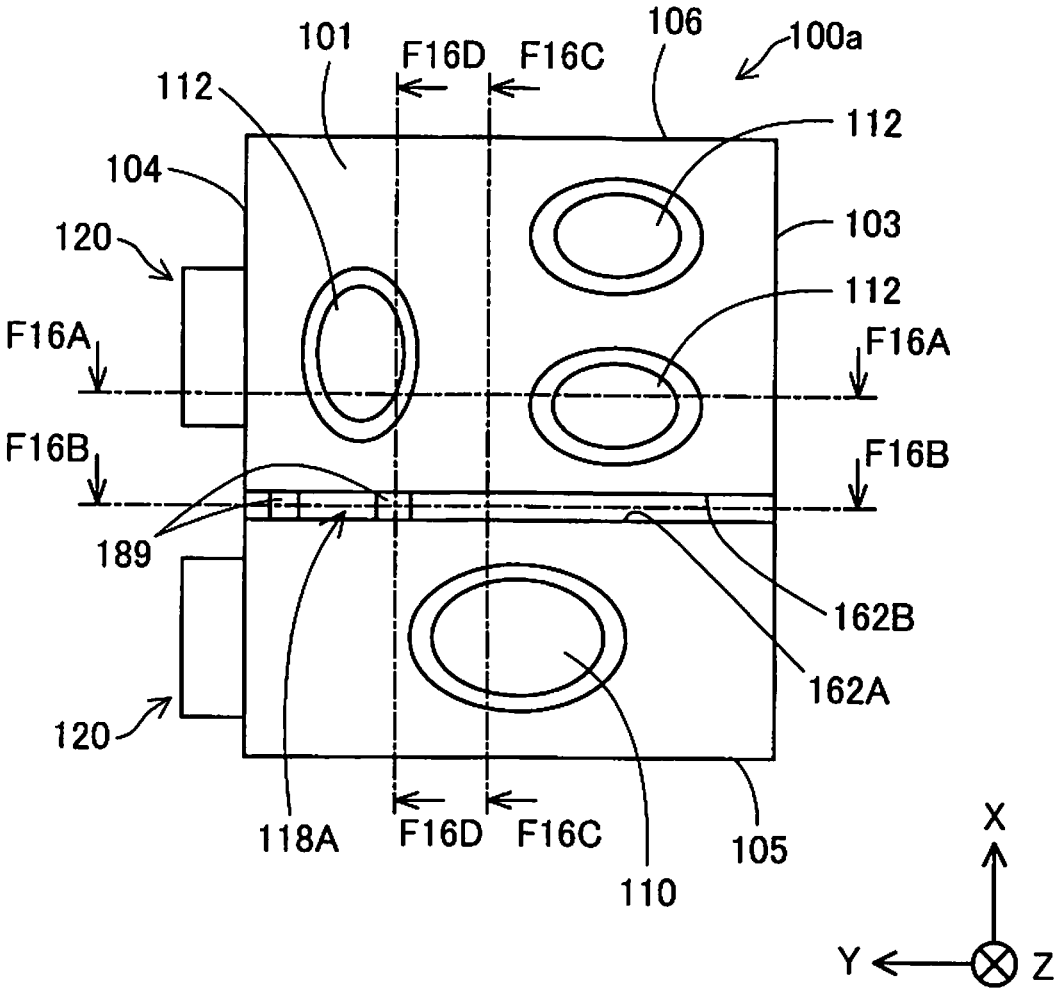
FIG. 16 is a bottom view of a liquid supply unit serving as a second embodiment.
Figure 17B:
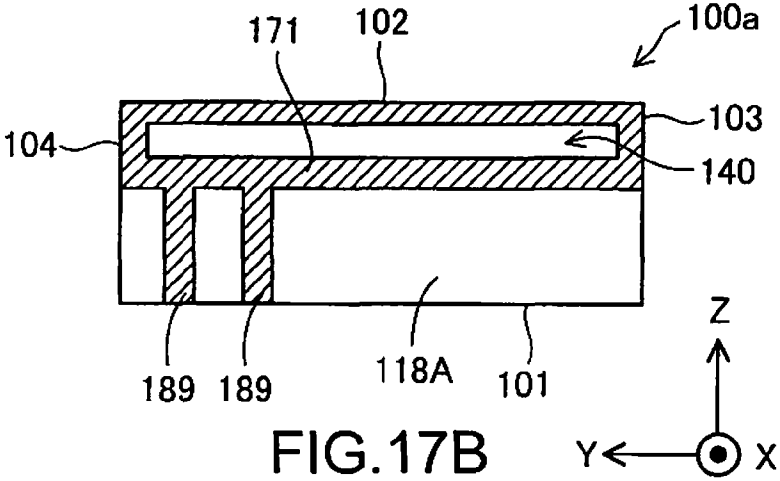
FIGS. 17A to 17D are diagrams for describing the liquid supply unit.
Figure 17A:
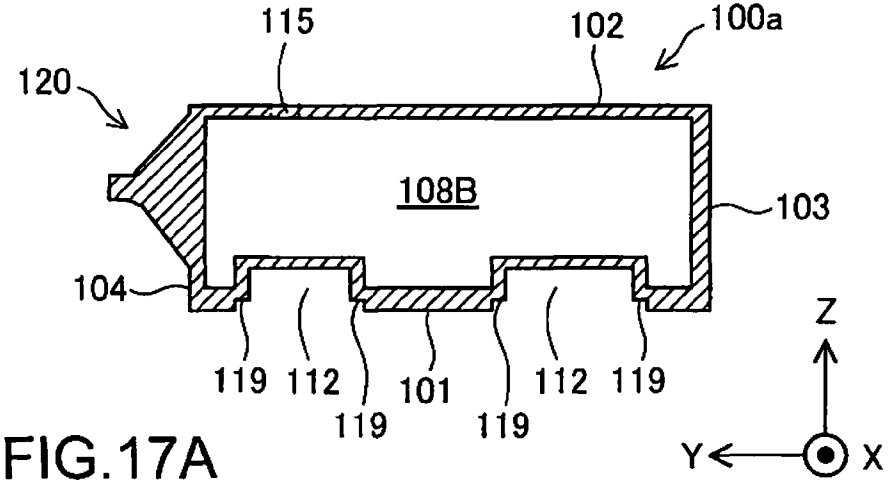
Figure 17D:
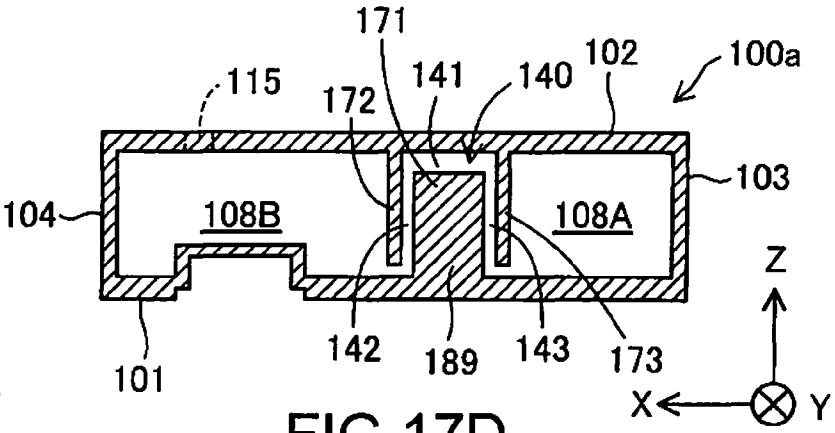
Figure 17C:
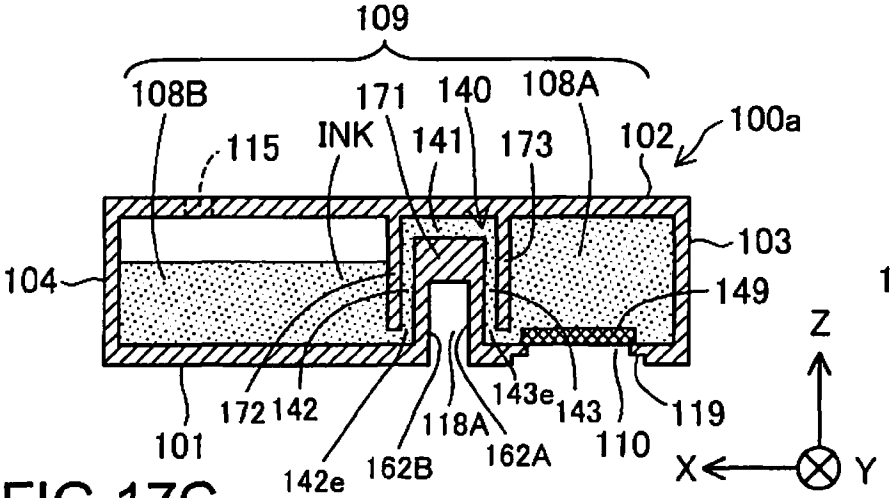

FIG. 16 is a bottom view of a liquid supply unit 100*a* serving as a second embodiment. FIGS. 17A to 17D are diagrams for describing the liquid supply unit 100*a*. FIG. 17A is a cross-sectional view along F16A-F16A in FIG. 16. FIG. 17B is a cross-sectional view along F16B-F16B in FIG. 16. FIG. 17C is a cross-sectional view along F16C-F16C in FIG. 16. FIG. 17D is a cross-sectional view along F16D-F16D in FIG. 16. The liquid supply unit 100*a* of the second embodiment differs from the liquid supply unit 100 of the first embodiment in that the liquid supply unit 100*a* is newly provided with a bridging part 189. Since the liquid supply unit 100*a* and the liquid supply unit 100 are similar in terms of the remaining configuration, the same reference signs will be given to the configuration that is similar and description thereof will be omitted. Also, the liquid supply unit 100*a* of the second embodiment is detachably mounted in the cartridge mounting part 27 (FIG. 4), similarly to the liquid supply unit 100 of the first embodiment.

As shown in FIGS. 16, 17B and 17D, the liquid supply unit 100*a* has bridging parts 189 that connect the first outer wall 162A and the second outer wall 162B. In this embodiment, two bridging parts 189 are provided in correspondence with the number of slits 223 (FIG. 4) in the partition wall 221A. Note that the number of bridging parts 189 is not limited thereto, and may, for example, be fewer than the number of slits 223. The bridging parts 189 are configured so as to be insertable in the corresponding slit 223. In other words, in the mounted state, the bridging parts 189 are inserted into the slit 223. As shown in FIG. 17B, the bridging parts 189 extend from the bottom surface (first channel wall 171) of the recessed gap 118A to the first wall 101. The bridging parts 189 are tabular members. The bridging parts 189 are integrally formed with an outer shell of the first wall 101 and the like. The bridging parts 189 thus connect the first outer wall 162A and the second outer wall 162B within the gap 118A. The strength of the liquid supply unit 100*a* having the gap 118A can thus be improved.

C. Third Embodiment

Figure 18:
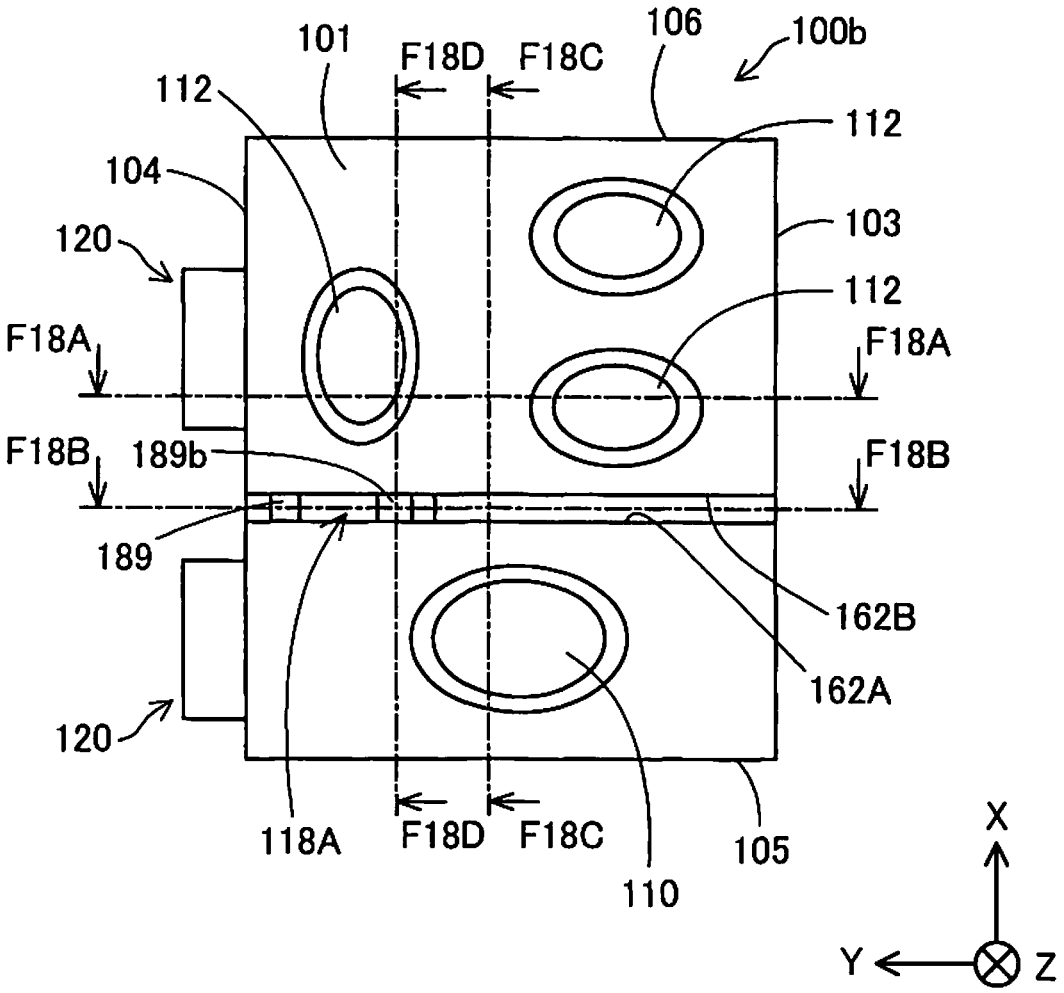
FIG. 18 is a bottom view of a liquid supply unit serving as a third embodiment.
Figure 19B:
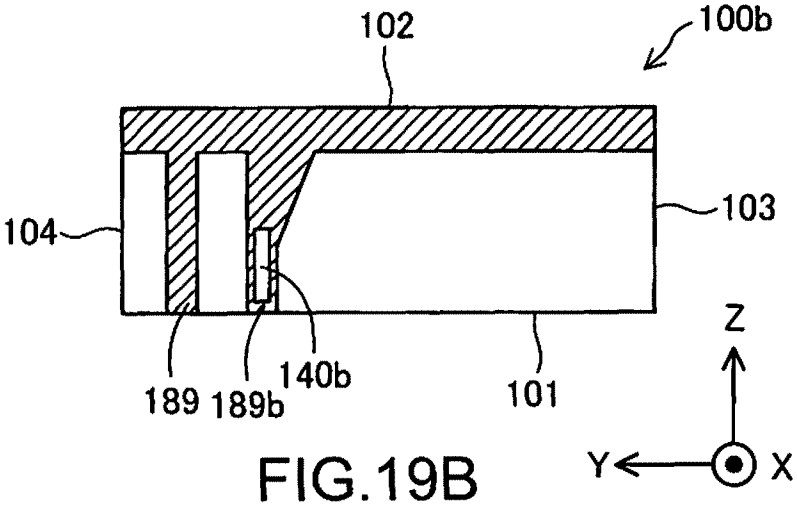
FIGS. 19A to 19D are diagrams for describing the liquid supply unit.
Figure 19A:
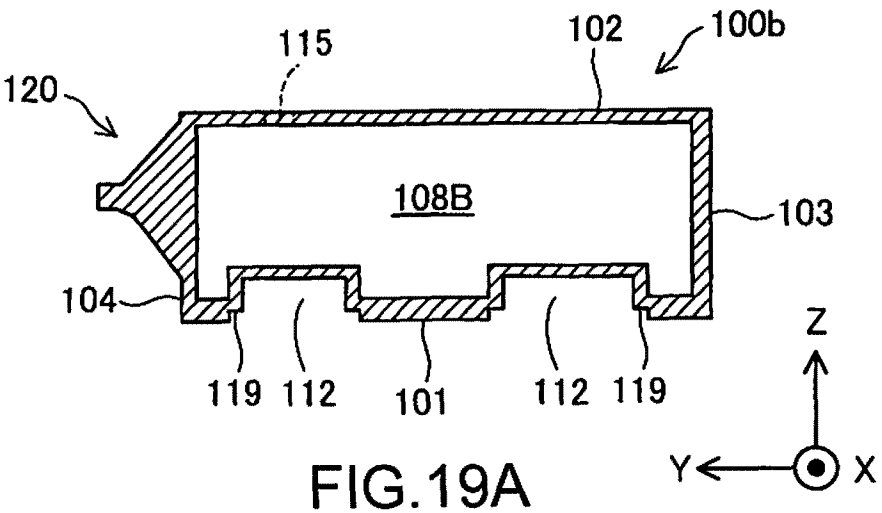
Figure 19D:
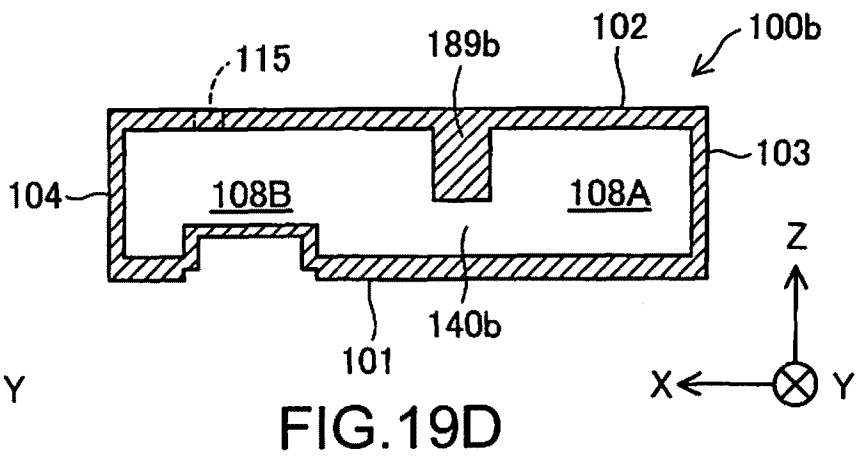
Figure 19C:
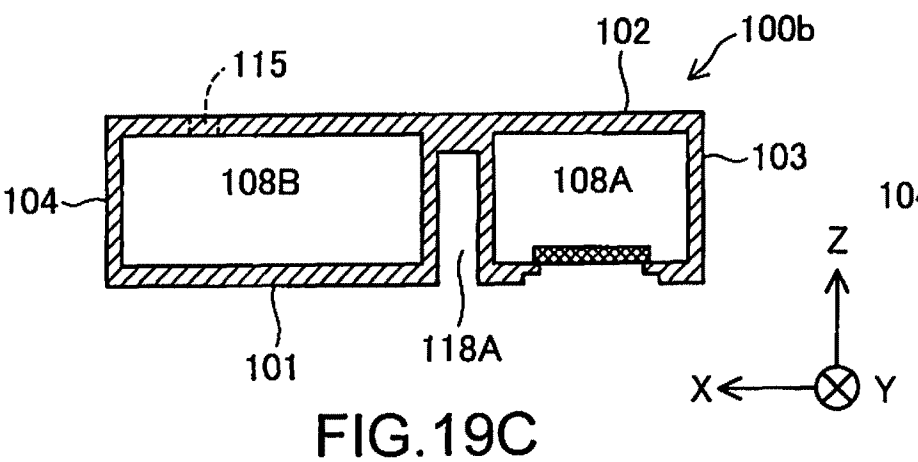

FIG. 18 is a bottom view of a liquid supply unit 100*b* serving as a third embodiment. FIGS. 19A to 19D are diagrams for describing the liquid supply unit 100*b*. FIG. 19A is a cross-sectional view along F18A-F18A in FIG. 18. FIG. 19B is a cross-sectional view along F18B-F18B in FIG. 18. FIG. 19C is a cross-sectional view along F18C-F18C in FIG. 18. FIG. 19D is a cross-sectional view along F18D-F18D in FIG. 18. The liquid supply unit 100*b* of the third embodiment differs from the liquid supply unit 100*a* of the second embodiment in that the liquid communication part 140*b* is provided with a bridging part 189*b*. Since the liquid supply unit 100*b* and the liquid supply unit 100*a* are similar in terms of the remaining configuration, the same reference signs will be given to the configuration that is similar and description thereof will be omitted. Also, the liquid supply unit 100*b* of the third embodiment is detachably mounted in the cartridge mounting part 27 (FIG. 4), similarly to the liquid supply unit 100 of the first embodiment.

As shown in FIG. 19B, the liquid supply unit 100*b* has two bridging parts 189 and 189*b* that connect the first outer wall 162A and the second outer wall 162B, similarly to the liquid supply unit 100*a* of the second embodiment. A liquid communication part 140*b* is formed in the bridging part 189*b* of the two bridging parts 189 and 189*b*. The liquid communication part 140*b* is a through hole passing through the bridging part 189*b* from the first liquid housing chamber 108A side to the second liquid housing chamber 108B side. The liquid communication part 140*b* is provided in a position closer to the first wall 101 than to the second wall part 102. In this embodiment, the liquid communication part 140*b* is adjacent to the first wall 101.

According to the third embodiment, in the liquid supply unit 100*b*, the liquid communication part 140*b* is provided in the bridging part 189*b*. The first liquid housing chamber 108A and the second liquid housing chamber 108B can thereby be communicated with each other by effectively utilizing the bridging part 189*b*. Also, the liquid communication part 140*b* is provided in a position of the bridging part 189*b* that is closer to the first wall 101 than to the second wall part 102. Ink housed in a portion (vicinity of the bottom surface) closer to the first wall 101 of the second liquid housing chamber 108B than to the second wall 102 can thereby be circulated to the first liquid housing chamber 108A.

In the third embodiment, the liquid communication part 140*b* is provided in one of the two bridging parts 189 and 189*b*, but may be provided in both of two bridging parts 189 and 189*b*. Also, the liquid communication part 140*b* provided in the bridging part 189*b* and the liquid communication part 140 (FIG. 14C) of the first embodiment may be used together.

D. Fourth Embodiment

Figure 20:
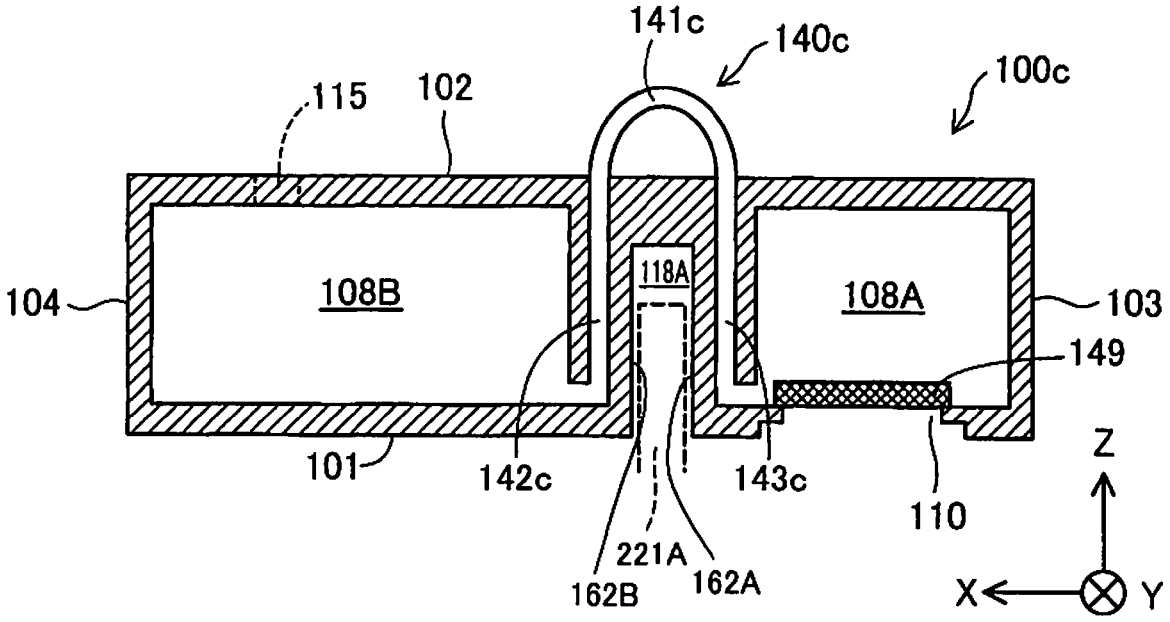
FIG. 20 is a diagram for describing a liquid supply unit serving as a fourth embodiment.

FIG. 20 is a diagram for describing a liquid supply unit 100*c* serving as a fourth embodiment. FIG. 20 is equivalent to FIG. 14C. The liquid supply unit 100*c* of the fourth embodiment differs from the liquid supply unit 100 (FIG. 14) of the first embodiment in the configuration of a first liquid channel 141*c* of the liquid communication part 140*c*. Since the liquid supply unit 100*c* and the liquid supply unit 100 are similar in terms of the remaining configuration, the same reference signs will be given to the configuration that is similar and description thereof will be omitted. Also, the liquid supply unit 100*c* of the fourth embodiment is detachably mounted in the cartridge mounting part 27 (FIG. 4), similarly to the liquid supply unit 100 of the first embodiment.

The first liquid channel 141*c* is constituted by a tube having flexibility. The upper end of both the second liquid channel 142*c* and the third liquid channel 143*c* is a through hole formed in the second wall 102. The first liquid channel 141*c* is configured so as to be connected to the through hole of the second liquid channel 142*c* and the third liquid channel 143*c*. The first liquid channel 141*c* is located directly above the partition wall 221A that is inserted into the gap 118A or the gap 118A, similarly to the first embodiment.

According to the embodiment, the degree of freedom in designing the liquid communication part 140*c* can be improved by at least a portion of the liquid communication part 140*c* (first liquid channel 141*c*) being constituted by a tube. In particular, in this embodiment, at least a portion of the liquid communication part 140*c* (first liquid channel 141*c*) is disposed further outside than the outer shell (walls 101 to 106) of the liquid supply unit 100*c*. The possibility of the disposition position being restricted by the structure of the interior space of the liquid supply unit 100*c* can thereby be reduced, when providing the liquid communication part 140*c*.

In the fourth embodiment, at least a portion of the liquid communication part 140*c* (first liquid channel 141*c*) is a tube having flexibility, but the invention is not limited thereto. For example, the tube may not have flexibility.

E. Fifth Embodiment

Figure 21:
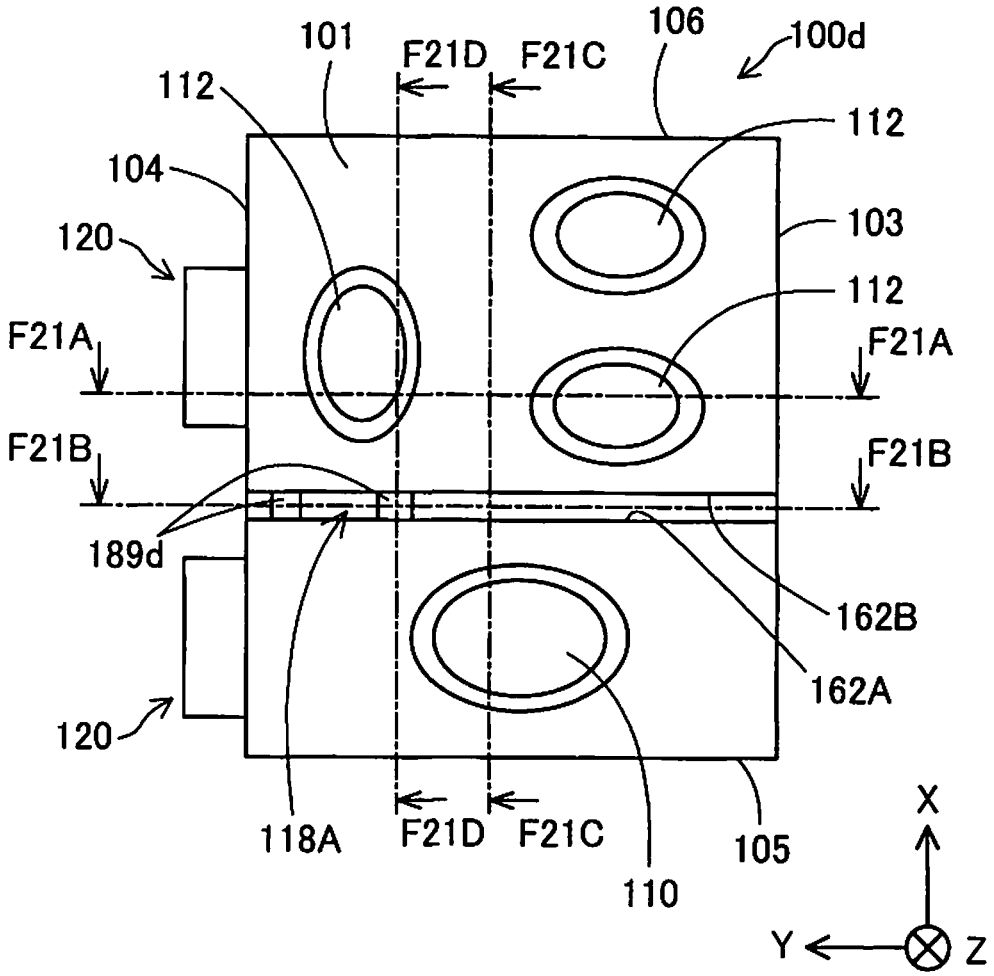
FIG. 21 is a bottom view of a liquid supply unit serving as a fifth embodiment.
Figure 22B:
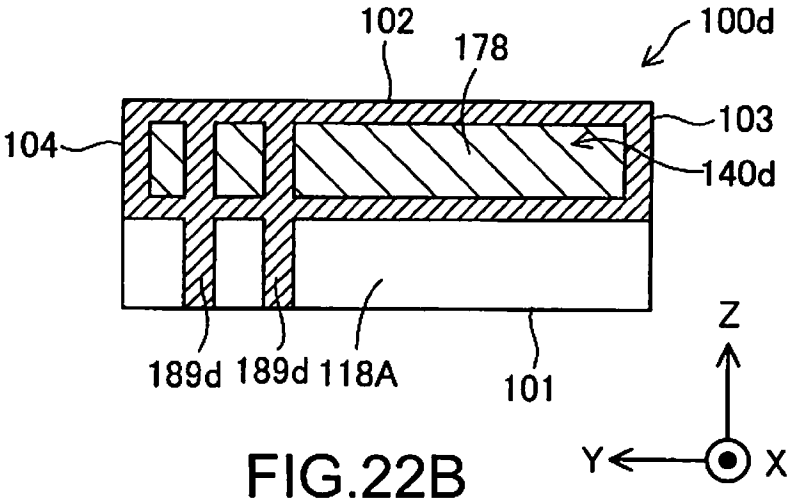
FIGS. 22A to 22D are diagrams for describing the liquid supply unit.
Figure 22A:
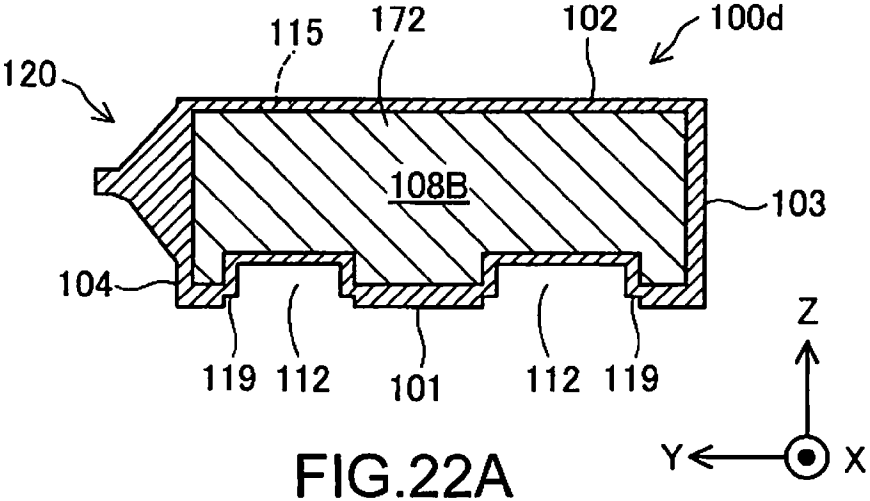
Figure 22D:
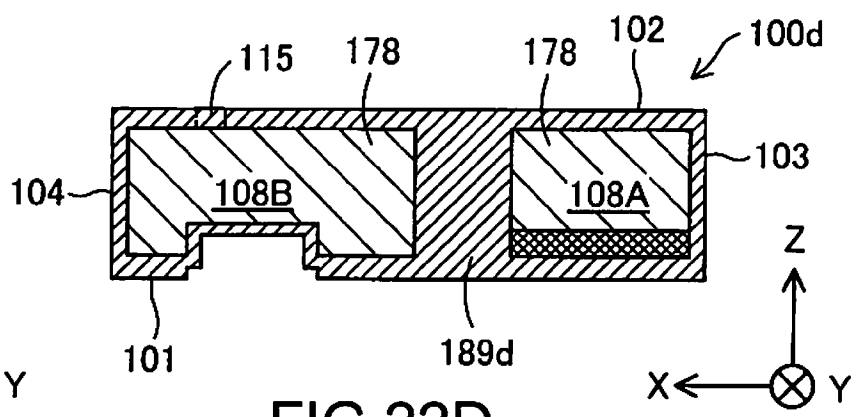
Figure 22C:
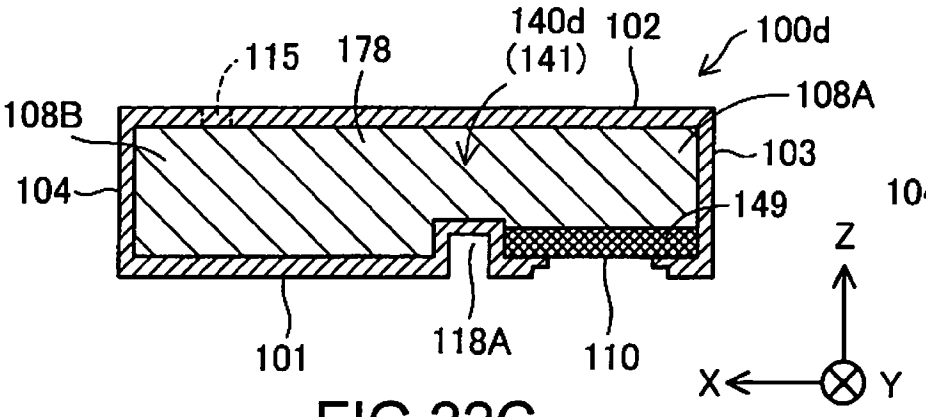

FIG. 21 is a bottom view of a liquid supply unit 100*d* serving as a fifth embodiment. FIGS. 22A to 22D are diagrams for describing the liquid supply unit 100*d*. FIG. 22A is a cross-sectional view along F21A-F21A in FIG. 21. FIG. 22B is a cross-sectional view along F21B-F21B in FIG. 21. FIG. 22C is a cross-sectional view along F21C-F21C in FIG. 21. FIG. 22D is a cross-sectional view along F21D-F21D in FIG. 21. The liquid supply unit 100*d* of the fifth embodiment differs from the liquid supply unit 100*a* (FIG. 17) of the second embodiment in that a first liquid holding member 178 is provided, in that a bridging part 189*d* extends from the first wall 101 to the second wall 102, and in the configuration of the liquid communication part 140*d*. Since the liquid supply unit 100*d* and the liquid supply unit 100*a* are similar in terms of the remaining configuration, the same reference signs will be given to the configuration that is similar and description thereof will be omitted. Also, the liquid supply unit 100*d* of the fifth embodiment is detachably mounted in the cartridge mounting part 27 (FIG. 4), similarly to the liquid supply unit 100 of the first embodiment.

As shown in FIG. 22C, the liquid supply unit 100*d* has a first liquid holding member 178 disposed to span the first liquid housing chamber 108A, the second liquid housing chamber 108B and the liquid communication part 140*d*. The first liquid holding member 178 is for holding ink. The first liquid holding member 178 may, for example, be foam formed with polyurethane or the like, or a fiber member obtained by bundling processed polypropylene fibers. A supply part side liquid holding member 149 serving as a second liquid holding member is disposed between the liquid supply part 110 and the first liquid holding member 178. In this embodiment, the supply part side liquid holding member 149 is disposed between the liquid supply part 110 and the first liquid holding member 178 so as to contact both the liquid supply part 110 and the first liquid holding member 178. The supply part side liquid holding member 149 is preferably a member with a higher capillary force than the first liquid holding member 178. This enables ink in the first liquid housing chamber 108A to be moved smoothly toward to the liquid supply part 110 side.

The liquid communication part 140*d* does not have the second liquid channel 142 or the third liquid channel 143 (FIG. 14C), and is formed by only the first liquid channel 141. In other words, the liquid supply unit 100*d* does not have the first partition wall 172 or the second partition wall 173 (FIG. 14C) for partitioning off the second liquid channel 142 or the third liquid channel 143.

According to the fifth embodiment, ink in the second liquid housing chamber 108B can be smoothly moved to the first liquid housing chamber via the liquid communication part 140*d* by the first liquid holding member 178. Also, since ink can be held in the supply part side liquid holding member 149, the possibility of ink leaking from the liquid supply part 110 can be reduced.

F. Sixth Embodiment

Figure 23:
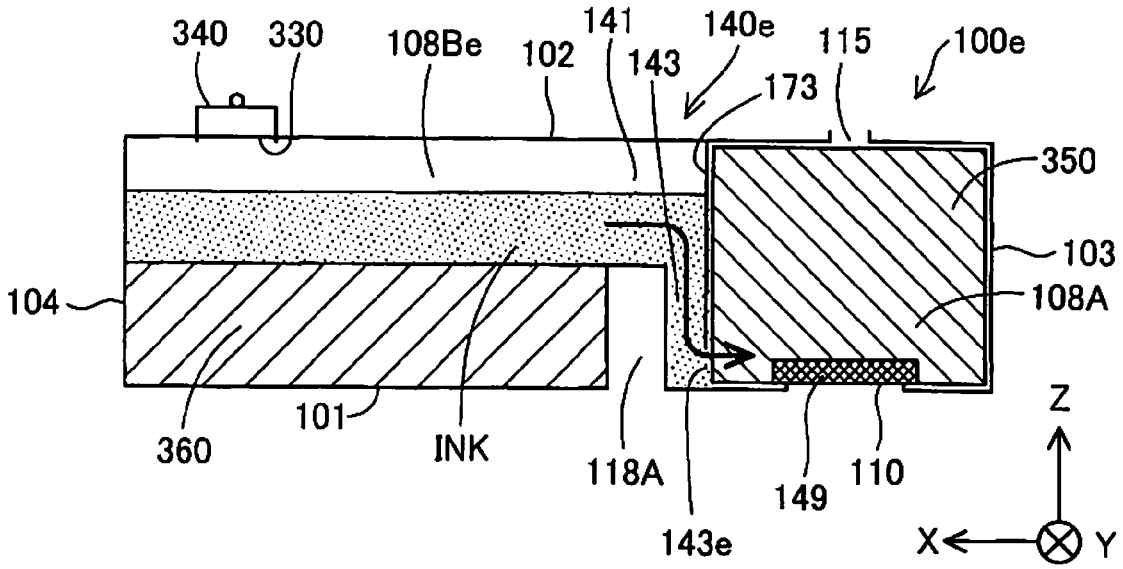
FIG. 23 is a diagram for describing a liquid supply unit serving as a sixth embodiment.

FIG. 23 is a diagram for describing a liquid supply unit 100*e* serving as the sixth embodiment. FIG. 23 is equivalent to FIG. 14C. The liquid supply unit 100*e* of the sixth embodiment differs from the liquid supply unit 100 (FIG. 14) of the first embodiment in that a liquid injection hole 330, a plug member 340, and a base 360 are newly provided, in that a liquid holding member 350 is provided in the first liquid housing chamber 108A, and in the configuration of the liquid communication part 140*e*. Since the liquid supply unit 100*e* and the liquid supply unit 100 are similar in terms of the remaining configuration, the same reference signs will be given to the configuration that is similar and description thereof will be omitted.

In the liquid supply unit 100*e*, an atmosphere communication passage 115 is formed in the portion of the second wall 102 that partitions off the first liquid housing chamber 108A. In other words, the atmosphere communication passage 115 communicates with the atmosphere outside the liquid supply unit 100*e* and the first liquid housing chamber 108A. Also, a liquid holding member 350 for holding ink is disposed in the first liquid housing chamber 108A. This liquid holding member 350 may be the same member as the supply part side liquid holding member 149 or may be a different member. The liquid holding member 350 is disposed so as to contact the one end 143*e* of the third liquid channel 143 and the supply part side liquid holding member 149.

Also, a liquid injection hole 330 for injecting ink into a second liquid housing chamber 108Be is formed in the second wall 102. Ink can be easily injected into the second liquid housing chamber 108Be using the liquid injection hole 330. Also, the liquid supply unit 100*e* has a plug member 340 for closing the liquid injection hole 330, and is detachably attached to the liquid injection hole 330. The bottom surface of the second liquid housing chamber 108Be is raised to the bottom surface (end surface on +Z direction side) of the gap 118A by the base 360. The liquid communication part 140*e* is provided with the first liquid channel 141 and the third liquid channel 143, and is not provided with the second liquid channel 142. In this liquid supply unit 100*e*, the atmosphere (air) is introduced from the atmosphere communication passage 115 with the consumption of ink INK in the first liquid housing chamber 108A, and the ink INK is smoothly introduced to the first liquid housing chamber 108A from the second liquid housing chamber 108Be via the liquid communication part 140*e*. Note that, in FIG. 23, the arrow indicates the flow of the ink from the second liquid housing chamber 108Be to the first liquid housing chamber 108A.

G. Seventh Embodiment

Figure 24:
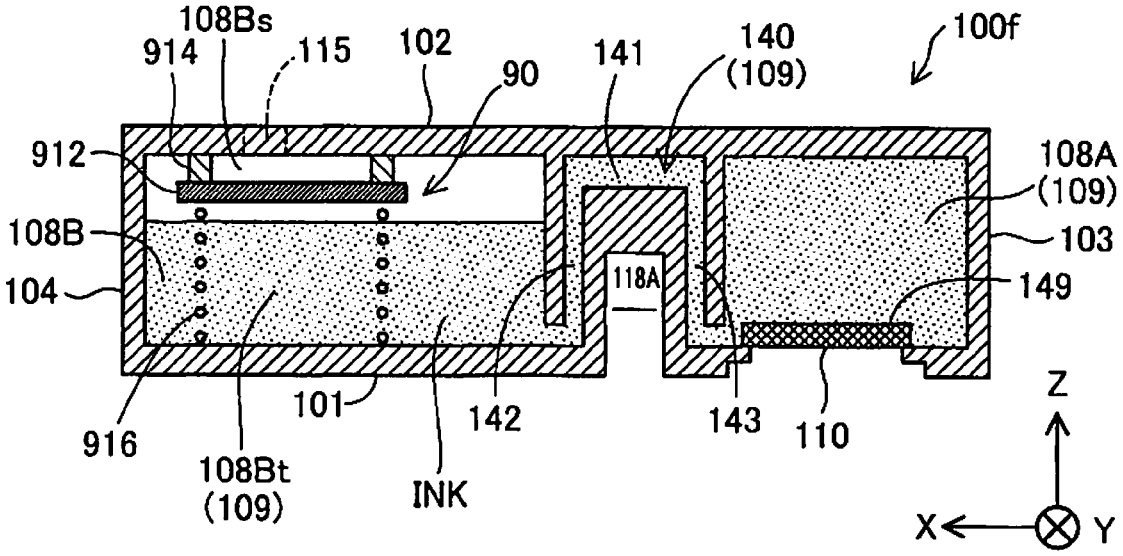
FIG. 24 is a diagram for describing a liquid supply unit serving as a seventh embodiment.
Figure 25B:
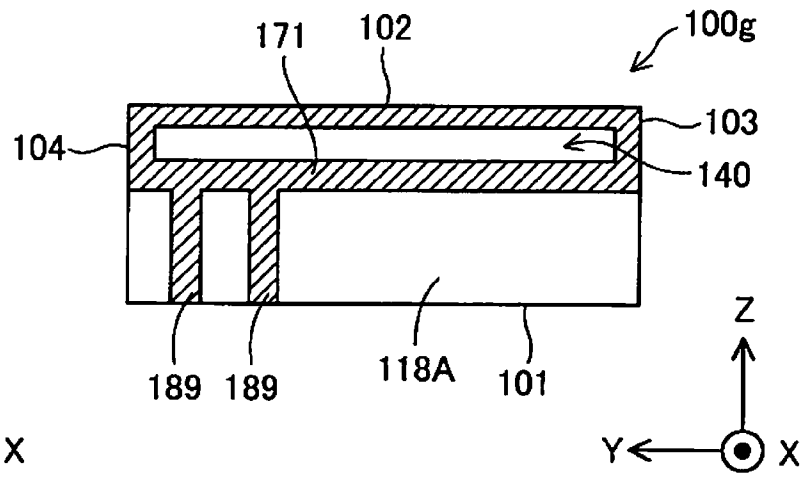
FIGS. 25A to 25D are diagrams for describing a liquid supply unit serving as an eighth embodiment.
Figure 25A:
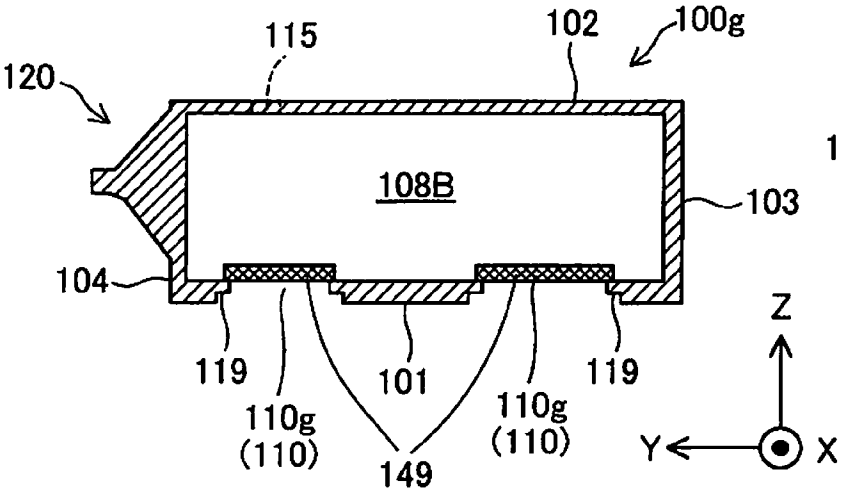
Figure 25D:
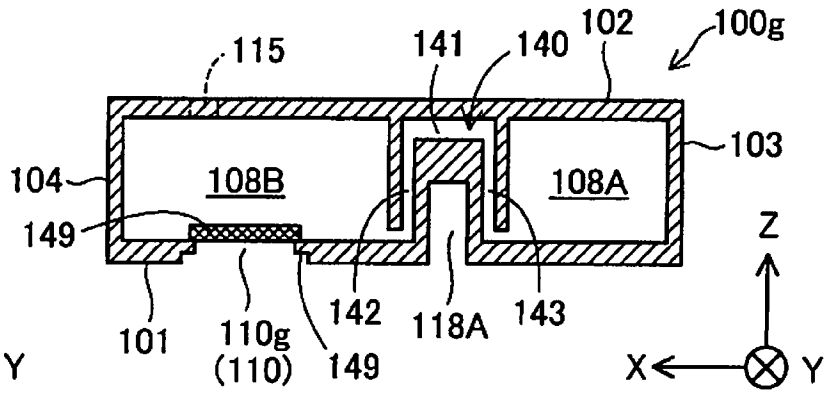
Figure 25C:
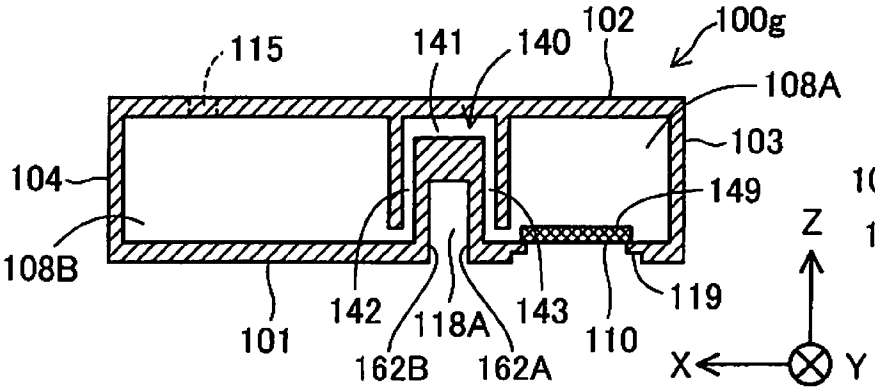

FIG. 24 is a diagram for describing a liquid supply unit 100*f* serving as a seventh embodiment. FIG. 24 is equivalent to FIG. 14C. The liquid supply unit 100*f* of the seventh embodiment differs from the liquid supply unit 100 (FIG. 14) of the first embodiment in that a valve mechanism 90 is provided in the second liquid housing chamber 108B. Since the liquid supply unit 100*f* and the liquid supply unit 100 are similar in terms of the remaining configuration, the same reference signs will be given to the configuration that is similar and description thereof will be omitted.

The valve mechanism 90 is provided with a valve seat 914, a membrane valve 912, and a coil spring 916 that serves as a biasing member. As a result of the valve mechanism 90, the inside of the liquid housing space 109 is maintained at negative pressure. The valve seat 914 is a circular raised part of the second wall 102 that projects inside the second liquid housing chamber 108B so as to surround the atmosphere communication passage 115. The membrane valve 912 is discoid and abuts against the valve seat 914. In the flow direction of fluid (e.g., ink or air) to the second liquid housing chamber 108B from the atmosphere communication passage 115 and to the first liquid housing chamber 108A through the liquid communication part 140, the membrane valve 912 is disposed between an upstream side portion 108Bs to which the second liquid housing chamber 108B to which the atmosphere communication passage 115 is connected, and a downstream side portion 108Bt of the second liquid housing chamber 108B to which the liquid communication part 140 is connected. In the case where the ink in the first liquid housing chamber 108A is consumed by the suction of the printing apparatus 10, and the negative pressure of the downstream side portion 108Bt of the second liquid housing chamber 108B becomes greater than or equal to a predetermined value, the membrane valve 912 moves in a direction away from the valve seat 914 against the biasing force of the coil spring 916. The upstream side portion 108Bs and the downstream side portion 108Bt will thereby enter a communication state, and air is introduced to the downstream side portion 108Bt via the atmosphere communication passage 115. In the case where atmosphere is introduced to the downstream side portion 108Bt, and the negative pressure of the downstream side portion 108Bt becomes smaller than the predetermined value, the membrane valve 912 abuts against the valve seat 914 due to the biasing force of the coil spring 916. The downstream side portion 108Bt and the upstream side portion 108Bs thereby enter a non-communication state.

As described above, the valve mechanism 90 is able to switch the atmosphere communication passage 115 and the second liquid housing chamber 108B (specifically, the downstream side portion 108Bt) between the communication state and the non-communication state according to the pressure in the second liquid housing chamber 108B (specifically, the downstream side portion 108Bt). Also, given that the liquid housing space 109 including the downstream side portion 108Bt, the liquid communication part 140 and the first liquid housing chamber 108A can be maintained at negative pressure using the valve mechanism 90, the possibility of ink leaking from the liquid supply part 110 can be reduced.

H. Eighth Embodiment

FIGS. 25A to 25D are diagrams for describing a liquid supply unit 100*g* serving as an eighth embodiment. FIGS. 25A to 25D correspond to FIGS. 14A to 14D. The liquid supply unit 100*g* of the eighth embodiment differs from the liquid supply unit 100*a* (FIG. 17) of the second embodiment in that the recessed parts 112 of the liquid supply unit 100 are replaced by liquid supply parts 110, and in that supply part side liquid holding members 149 are provided in correspondence with the replaced liquid supply parts 110. Since the liquid supply unit 100*g* and the liquid supply unit 100*a* are similar in terms of the remaining configuration, the same reference signs will be given to the configuration that is similar and description thereof will be omitted. Also, the liquid supply unit 100*g* of the eighth embodiment is detachably mounted in the cartridge mounting part 27 (FIG. 4), similarly to the liquid supply unit 100 of the first embodiment.

The three liquid supply parts 110 serving as second liquid supply parts are formed in the portion of the first wall 101 that partitions off the second liquid housing chamber 108B (only two are illustrated in FIG. 24). The liquid supply parts 110 formed in the second liquid housing chamber 108B are also called second liquid supply parts 110*g*. Within the second liquid housing chamber 108B, supply part side liquid holding members 149 are disposed so as to close the second liquid supply parts 110*g*.

According to the eighth embodiment, the liquid supply unit 100*g* has bridging parts 189 that connect the first outer wall 162A and the second outer wall 162B, and that are inserted into the slits 223 in the partition wall 221A in the mounted state. The strength of the liquid supply unit 100*g* having the gap 118A can thereby be improved. Also, ink housed in the second liquid housing chamber 108B can be directly supplied to the second liquid introduction part 212. Also, since the first liquid housing chamber 108A and the second liquid housing chamber 108B are in communication using the liquid communication part 140, ink can be circulated between the first liquid housing chamber 108A and the second liquid housing chamber 108B. That is, even in the case where the ink level of one liquid housing chamber falls below the ink level of the other liquid housing chamber, ink in the other liquid housing chamber can be circulated to the one liquid housing chamber.

I. Variations

Note that this invention is not limited to the above examples and embodiments, and can be implemented in various aspects in a range that does not depart from the spirit of the invention. For example, the following variations are also possible.

I-1. First Variation

Figure 26:
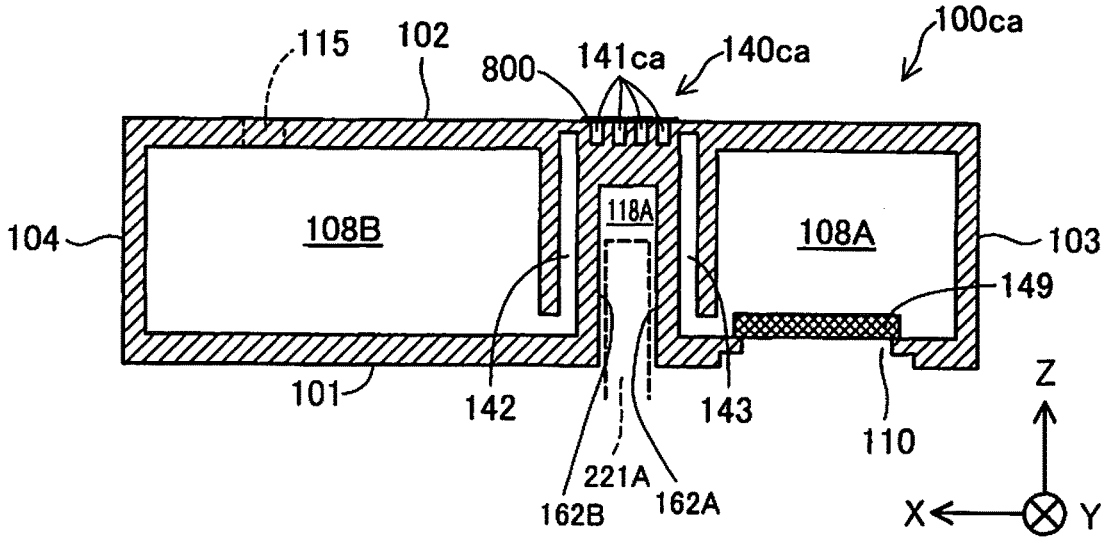
FIG. 26 is a diagram for describing a variation of a liquid communication part.

FIG. 26 is a diagram for describing the variation of a liquid communication part 140*ca*. FIG. 26 is equivalent to FIG. 20. A liquid supply unit 100*ca* shown in FIG. 26 differs from the liquid supply unit 100*c* of the fourth embodiment shown in FIG. 20 in the configuration of first liquid channels 141*ca*. Since the liquid supply unit 100*c* and the liquid supply unit 100*ca* are the same with regard to the remaining configuration, the same reference signs will be given to the configuration that is similar and description thereof will be omitted. At least a portion of the liquid communication part 140*ca* may be formed in the second wall 102. In this variation, the first liquid channels 141*ca* of the liquid communication part 140*ca* are formed in the second wall 102. Specifically, grooves are formed in the outer surface of the second wall 102, and a sealing member 800 is adhered to the second wall 102 so as to cover the grooves. The first liquid channels 141*ca* are thereby formed. The sealing member 800 is a film that is impervious to ink. The grooves may have a shape that is able to connect the second liquid channel 142 and the third liquid channel 143, and may have a meandering shape or a linear shape. This enables at least a portion of the liquid communication part 140*ca* to be formed utilizing the second wall 102. Note that although the above configuration is described here as a variation of the fourth embodiment, this variation in which at least a portion of the liquid communication part 140*ca* is formed in the second wall 102 may be applied to the other embodiments.

I-2. Second Variation

Figure 27:
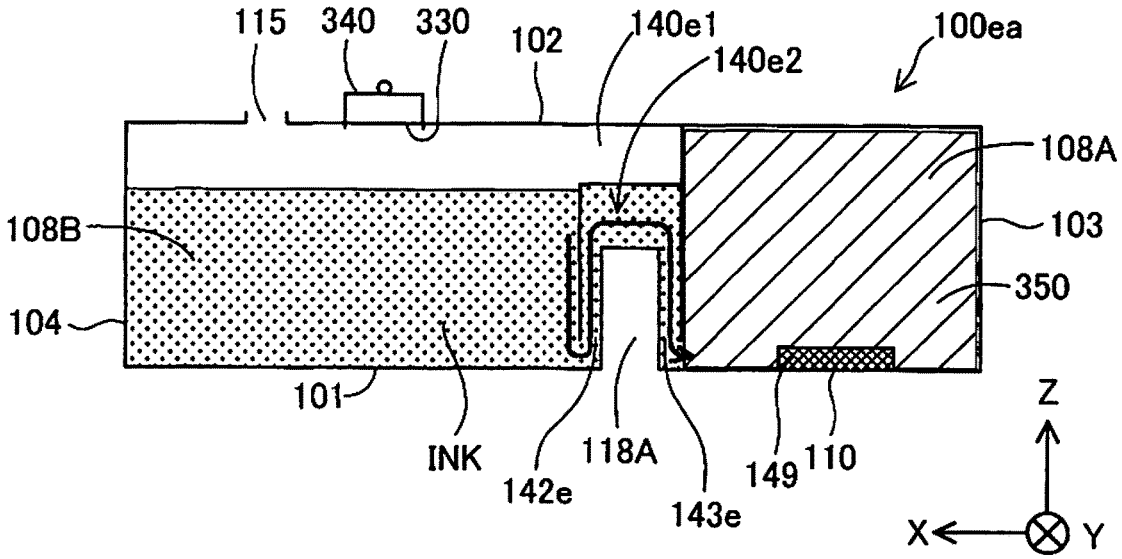
FIG. 27 is a diagram for describing a liquid supply unit serving as a variation of the sixth embodiment.

FIG. 27 is a diagram for describing a liquid supply unit 100*ea* serving as a variation of the sixth embodiment. In the sixth embodiment, one liquid communication part 140*e* was provided, but more than one may be provided. For example, the liquid supply unit 100*ea* has an upper liquid communication part 140*e*1 and a lower liquid communication part 140*e*2 that have different paths. The upper liquid communication part 140*e*1 is located between the lower liquid communication part 140*e*2 and the second wall 102. The lower liquid communication part 140*e*2 is located between the upper liquid communication part 140*e*1 and the gap 118A. The first end 142*e* of the lower liquid communication part 140*e*2 is open inside the second liquid housing chamber 108B in a position closer to the first wall 101 than to the second wall part 102. The second end 143*e* of the lower liquid communication part 140*e*2 is open inside the first liquid housing chamber 108A at a position closer to the first wall 101 than to the second wall part 102. The lower liquid communication part 140*e*2 is a channel that straddles the gap 118A and communicates the first liquid housing chamber 108A and the second liquid housing chamber 108B.

The atmosphere communication passage 115 communicates the second liquid housing chamber 108B and the outside air. Note that the atmosphere communication passage 115 is not formed in the portion of the second wall 102 that partitions off the first liquid housing chamber 108A. Atmosphere is introduced to the first liquid housing chamber 108A through the upper liquid communication part 140*e*1 as the ink in the first liquid housing chamber 108A is consumed, and ink in the second liquid housing chamber 108B is mainly introduced to the first liquid housing chamber 108A through the lower liquid communication part 140*e*2. This enables ink in the second liquid housing chamber 108B to be efficiently introduced to the first liquid housing chamber 108A, even in the case where a portion of the second liquid housing chamber 108B is formed on the lower side of the bottom surface (surface on +Z direction side) of the recessed gap 118A.

I-3. Third Variation

In the above embodiments, the atmosphere communication passage 115 may be in communication with the second liquid housing chamber 108B, may be in communication with the first liquid housing chamber 108A, or may be in communication with both the first and second liquid housing chambers 108A and 108B. In the case where the atmosphere communication passage 115 is communicated with both the first and second liquid housing chambers 108A and 108B, a through hole may, for example, be formed in both the portion of the second wall 102 that partitions off the first liquid housing chamber 108A and the portion of the second wall 102 that partitions off the second liquid housing chamber 108B.

I-4. Fourth Variation

The invention is not limited to an inkjet printer and a liquid supply unit for supplying ink to an inkjet printer, and can also be applied to any liquid jet apparatus that jets another liquid other than ink, and to a liquid supply unit (liquid housing container) for housing that liquid. For example, the invention is applicable to various types of liquid jet apparatuses and liquid supply units thereof such as the following.

(1) Image recorders such as a facsimile machine.

(2) Color material jet apparatuses that are used in manufacturing color filters for image displays such as a liquid crystal display.

(3) Electrode material jet apparatuses that are used in electrode formation for organic EL (electroluminescence) displays, field emission displays (FED), and the like.

(4) Liquid jet apparatuses that jet liquids including bio-organic matter that is used in biochip manufacture.

(5) Sample jet apparatuses serving as precision pipettes.

(6) Jet apparatuses for lubricating oil.

(7) Jet apparatuses for resin liquid.

(8) Liquid jet apparatuses that jet lubricating oil onto precision instruments such as clocks and cameras with pinpoint accuracy.

(9) Liquid jet apparatuses that jet a transparent resin liquid such as an ultraviolet curing resin liquid onto a substrate in order to form minute semispherical lenses (optical lens) or the like that are used for an optical communication element and the like.

(10) Liquid jet apparatuses that jet an acid or alkaline etching solution in order to etch substrates and the like.

(11) Liquid jet apparatuses provided with a liquid jet head that ejects minute droplets of another arbitrary liquid.

Note that "liquid droplets" refers to the state of the liquid ejected from the liquid jet apparatus, and is deemed to include granular droplets, tear-shaped droplets, and thread-like droplets having a trailing end. Also, a "liquid" as referred to here may be any material that can be jetted by a liquid jet apparatus. For example, the "liquid" may be any material in a liquid phase, examples of which include materials in a liquid state having high or low viscosity, sol, gel water, and other materials in a liquid state such as inorganic solvents, organic solvents, solutions, liquid resins, and liquid metals (metal melts). Examples of a "liquid" include not only a liquid as one state of a substance but also a material obtained by dissolving, dispersing or mixing particles of functional materials consisting of solids such pigments or metal particles in a solvent. Typical examples of a liquid include liquid crystal and ink such as described in the above embodiments. Here, "ink" is deemed to encompass various liquid composites such as gel ink and hot melt ink as well as common water-based ink and oil-based ink.

The invention is not limited to the abovementioned embodiments and examples, and can be realized with various configurations in a range that does not depart from the spirit of the invention. For example, the embodiments corresponding to the technical features in the various modes described in the summary of the invention, the examples and the technical features in the variations can be replaced or combined as appropriate, in order to solve some or all of the abovementioned problems, or in order to achieve some or all of the abovementioned effects. Also, any of these technical features that were not described in the specification as being essential can be deleted as appropriate.

What is claimed is:

1. A liquid supply unit mountable in a liquid jet apparatus that includes a first mounting part having a liquid introduction part, a second mounting part, and a partition wall having a slit and separating the first mounting part and the second mounting part, the liquid supply unit comprising:

a bottom wall, an upper wall opposing the bottom wall;

a first outer wall and a second outer wall intersecting the bottom wall and the upper wall;

a first liquid housing chamber adapted to be mounted in the first mounting part in a mounted state in which the liquid supply unit is mounted in the liquid jet apparatus, the first liquid housing chamber defined by the first outer wall;

a second liquid housing chamber adapted to be mounted in the second mounting part in the mounted state, the second liquid housing chamber defined by the second outer wall;

a liquid supply part adapted to be connected to the liquid introduction part and supplying a liquid to the liquid introduction part in the mounted state, the liquid supply part provided on the bottom wall and communicating with the first liquid housing chamber;

a liquid communication part communicating with the first liquid housing chamber and the second liquid housing chamber; and, a gap configured to receive the partition wall in the mounted state, the gap formed between the first outer wall and the second outer wall.

2. The liquid supply unit according to claim 1, the liquid supply unit further comprising:

a first terminal adapted to be electrically connected to a first electrode part in the first mounting part of the liquid jet apparatus;

a second terminal adapted to be electrically connected to a second electrode part in the second mounting part of the liquid jet apparatus;

a first engagement part adapted to abut against a first engaging part, in the first mounting part of the liquid jet apparatus in the mounted state; and a second engagement part adapted to abut against a second engaging part in the second mounting part of the liquid jet apparatus in the mounted state.

3. The liquid supply unit according to claim 1, wherein when the liquid supply unit is seen in plan view looking in a downward direction in which the upper wall faces the bottom wall, in the mounted state, the liquid communication part includes a first liquid channel that overlaps with the partition wall.

4. The liquid supply unit according to claim 3, wherein when the liquid supply unit is seen in plan view looking in the downward direction in the mounted state, the liquid communication part includes a second liquid channel that overlaps with the second mounting part.

5. The liquid supply unit according to claim 4, wherein when the liquid supply unit is seen in plan view looking in the downward direction in the mounted state, the liquid communication part includes a third liquid channel that overlaps with the first mounting part.

6. The liquid supply unit according to claim 3, wherein the first liquid channel is provided in a position closer to the upper wall than to the bottom wall.

7. The liquid supply unit according to claim 1, further comprising:

a bridging part connecting the first outer wall and the second outer wall, the bridging part configured to be inserted into the slit in the partition wall in the mounted state.

8. The liquid supply unit according to claim 7, wherein at least a portion of the liquid communication part is provided in the bridging part.

9. The liquid supply unit according to claim 8, wherein at least a portion of the liquid communication part is provided in the bridging part at a position closer to the bottom wall than to the upper wall.

10. The liquid supply unit according to claim 1, wherein at least a portion of the liquid communication part is constituted by a tube.

11. The liquid supply unit according to claim 1, wherein at least a portion of the liquid communication part is formed in the upper wall.

12. The liquid supply unit according to claim 1, further comprising:

a first liquid holding member disposed to span the first liquid housing chamber, the second liquid housing chamber and the liquid communication part.

13. The liquid supply unit according to claim 12, further comprising:

a second liquid holding member disposed, in the first liquid housing chamber, between the liquid supply part and the first liquid holding member.

14. The liquid supply unit according to claim 1, further comprising:

an atmosphere communication channel communicating with an atmosphere outside the liquid supply unit and the first liquid housing chamber; and a liquid holding member disposed in the first liquid housing chamber.

15. The liquid supply unit according to claim 1, further comprising:

an atmosphere communication channel communicating with an atmosphere outside the liquid supply unit and the second liquid housing chamber; and a valve mechanism that switches the atmosphere communication channel and the second liquid housing chamber between a communication state and a non-communication state, according to a pressure in the second liquid housing chamber.

16. The liquid supply unit according to claim 1, further comprising:

a liquid injection hole through which the liquid is injectable into the second liquid housing chamber; and a plug member for closing the liquid injection hole, and attachable to and detachable from the liquid injection hole.

* * * * *